US010967484B2

(12) United States Patent
Wang et al.

(10) Patent No.: US 10,967,484 B2
(45) Date of Patent: Apr. 6, 2021

(54) COATED ABRASIVES HAVING A BLEND OF ABRASIVE PARTICLES AND INCREASED TEAR RESISTANCE

(71) Applicants: SAINT-GOBAIN ABRASIVES, INC., Worcester, MA (US); SAINT-GOBAIN ABRASIFS, Conflans-Sainte-Honorine (FR)

(72) Inventors: Fei Wang, Stoneham, MA (US); Charles G. Herbert, Shrewsbury, MA (US); Doruk O. Yener, Bedford, MA (US); Anna Maassel, Blacksburg, VA (US); Anthony C. Gaeta, Lockport, NY (US); James M. Garrah, Burlington (CA); Dustin Jeremy James Parker, Woodstock (CA); Christopher J. Chilton, Sterling, MA (US); Anthony Truc Nguyen, Shrewsbury, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 118 days.

(21) Appl. No.: 15/795,982

(22) Filed: Oct. 27, 2017

(65) Prior Publication Data

US 2018/0117737 A1 May 3, 2018

Related U.S. Application Data

(60) Provisional application No. 62/414,692, filed on Oct. 29, 2016.

(51) Int. Cl.
*B24D 3/14* (2006.01)
*B24D 11/02* (2006.01)
(Continued)

(52) U.S. Cl.
CPC ..... *B24D 3/14* (2013.01); *B24D 3/28* (2013.01); *B24D 3/34* (2013.01); *B24D 11/02* (2013.01)

(58) Field of Classification Search
CPC ... B24D 3/14; B24D 3/28; B24D 3/34; B24D 11/02
See application file for complete search history.

(56) References Cited

U.S. PATENT DOCUMENTS 1,662,739 A * 3/1928 Curtis ..... C01F 7/027 23/305 A
5,223,095 A 6/1993 Kinsley, Jr.
(Continued)

FOREIGN PATENT DOCUMENTS

GB 1399564 A * 7/1975 ..... C09K 3/1418
WO 2014176108 A1 10/2014
(Continued)

OTHER PUBLICATIONS

International Search Report and Written Opinion for PCT/US2017/058742, dated Feb. 14, 2018, 12 pages.
(Continued)

*Primary Examiner* — Pegah Parvini
*Assistant Examiner* — Ross J Christie
(74) *Attorney, Agent, or Firm* — Abel Schillinger, LLP; Joseph Sullivan

(57) ABSTRACT

The present invention relates generally to coated abrasive articles that include a blend of abrasive particles, an increased tear resistance, or combinations thereof, as well as methods of making and using said coated abrasive articles.

20 Claims, 11 Drawing Sheets

(51) Int. Cl.
*B24D 3/28* (2006.01)
*B24D 3/34* (2006.01)

(56) References Cited

U.S. PATENT DOCUMENTS 5,304,224 A * 4/1994 Harmon ..... B24D 11/02 51/295
5,725,162 A * 3/1998 Garg ..... C04B 35/1115 241/1
5,885,311 A * 3/1999 McCutcheon ..... B24D 3/00 51/295
5,914,299 A * 6/1999 Harmer ..... B24D 3/285 51/295
6,391,072 B1 * 5/2002 Garg ..... C01F 7/02 51/296
2001/0049911 A1 12/2001 Swei et al.
2004/0072509 A1 * 4/2004 Hunt ..... B24D 9/006 51/295
2004/0109978 A1 * 6/2004 Michel ..... B24D 9/085 428/99
2006/0143989 A1 7/2006 Lindquist et al.
2013/0305614 A1 * 11/2013 Gaeta ..... B24D 3/20 51/298
2015/0101256 A1 * 4/2015 Liu ..... B24D 11/02 51/298
2015/0306739 A1 10/2015 Vervacke

FOREIGN PATENT DOCUMENTS

WO 2015154061 A1 10/2015
WO 2016160357 A1 10/2016
WO 2018081546 A1 5/2018

OTHER PUBLICATIONS

Lindquist, Mike, "The Importance of Using the Right Paper in Your Abrasives," Neenah Performance Materials—Multi-Task, accessed Mar. 11, 2016, 2 pages, Neenah Paper, Inc., Alpharetta, US.
McCoy, Lisa, "Tentative Physical Property Specifications—Neenah® DuraFlat® 150 gsm BC," Sep. 11, 2015, Neenah Paper, Inc..
The Global Preferred Choice in Coated Abrasive Backings, Neenah Peformance Materials, accessed Mar. 11, 2016, 2 pages, Neenah Paper, Inc.
Physical Property Specifications—Neenah® FPR 120 GSM Blue BC Finishing Paper, Neenah® DF 100 GSM FRP Blue Finishing Paper, 100 GSM FRP Champagne Finishing Paper, Sep. 25-26, 2013, 3 pages, Neenah Paper, Inc., Munising, US.

* cited by examiner

600

502

700

702

COATED ABRASIVES HAVING A BLEND OF ABRASIVE PARTICLES AND INCREASED TEAR RESISTANCE

CROSS REFERENCE TO RELATED APPLICATION

The present application claims priority under 35 U.S.C. § 119(e) to U.S. Provisional Patent Application No. 62/414,692, filed Oct. 29, 2016, entitled "Coated Abrasives having a Blend of Abrasive Particles and Increased Tear Resistance," naming inventors Fei Wang et al., which is assigned to the current assignee hereof and is incorporated by reference herein in its entirety.

FIELD OF THE INVENTION

The present invention relates generally to coated abrasive articles that include a blend of abrasive particles, an increased tear resistance, or combinations thereof, as well as methods of making and using said coated abrasive articles.

BACKGROUND

Abrasive articles, such as coated abrasives, are used in various industries to machine work pieces, such as by lapping, grinding, and polishing. Surface processing using abrasive articles spans a wide industrial scope from initial coarse material removal to high precision finishing and polishing of surfaces at a submicron level.

Effective and efficient abrasion of the surfaces of composites, particularly reinforced composites, such as fiberglass reinforced composites, which are becoming more and more prevalent in industries, such as the automotive industry, that require low weight and high strength, pose numerous processing challenges.

Industries that produce or rely on such composites are sensitive to factors that influence operational costs, including the speed at which a surface can be prepared, the cost of the materials used to prepare that surface, and the costs associated with the time expended to prepare a surface. Typically, these industries seek to achieve cost effective abrasive materials and processes that achieve high material removal rates. However, abrasives and abrasive processes that exhibit high removal rates often also tend to exhibit poor performance, if not impossibility, in achieving desired surface characteristics associated with high precision finishing and polishing of surfaces. Conversely, abrasives that produce such desirable surface characteristics often have low material removal rates, which can require more time and effort to remove a sufficient amount of surface material.

Therefore, there continues to be a demand for improved abrasive products and methods that can offer enhanced abrasive processing performance, efficiency, and improved surface quality.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
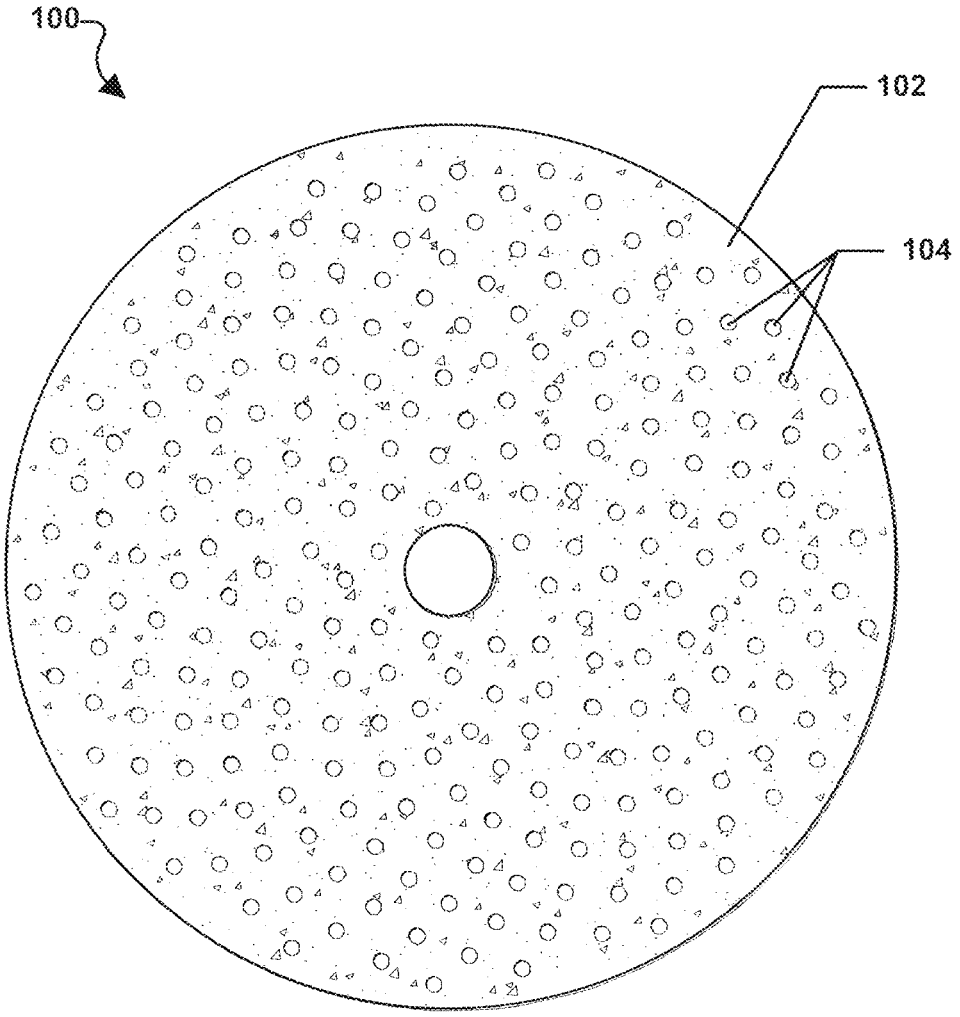
FIG. 1 is an illustration of an embodiment of a coated abrasive article that includes a blend of abrasive particles and increased tear resistance.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following:

A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

Coated Abrasive Article

Referring initially to FIG. 1, a coated abrasive article 100 is illustrated. As depicted in FIG. 1, the coated abrasive article 100 can include a body 102 that, in a particular example, can be generally disc shaped. The body 102 of the coated abrasive article 100 may include a plurality of holes 104. In particular, the holes 104 can be vacuum holes. In such an embodiment, the coated abrasive article 100 can be configured to be removably engaged with a sanding tool (not depicted) such as a random orbit sander. The random orbit sander may be coupled to a vacuum system and the holes 104 in the body 102 of the coated abrasive article 100 may serve to facilitate the removal of dust that is typically generated during the abrasion of a surface using the coated abrasive article 102. It can be appreciated that the body 102 of the coated abrasive article 100 may have any other shape well known to one of ordinary skill in the art. For example, that shape may be triangular, square, rectangular, etc.

Figure 2:
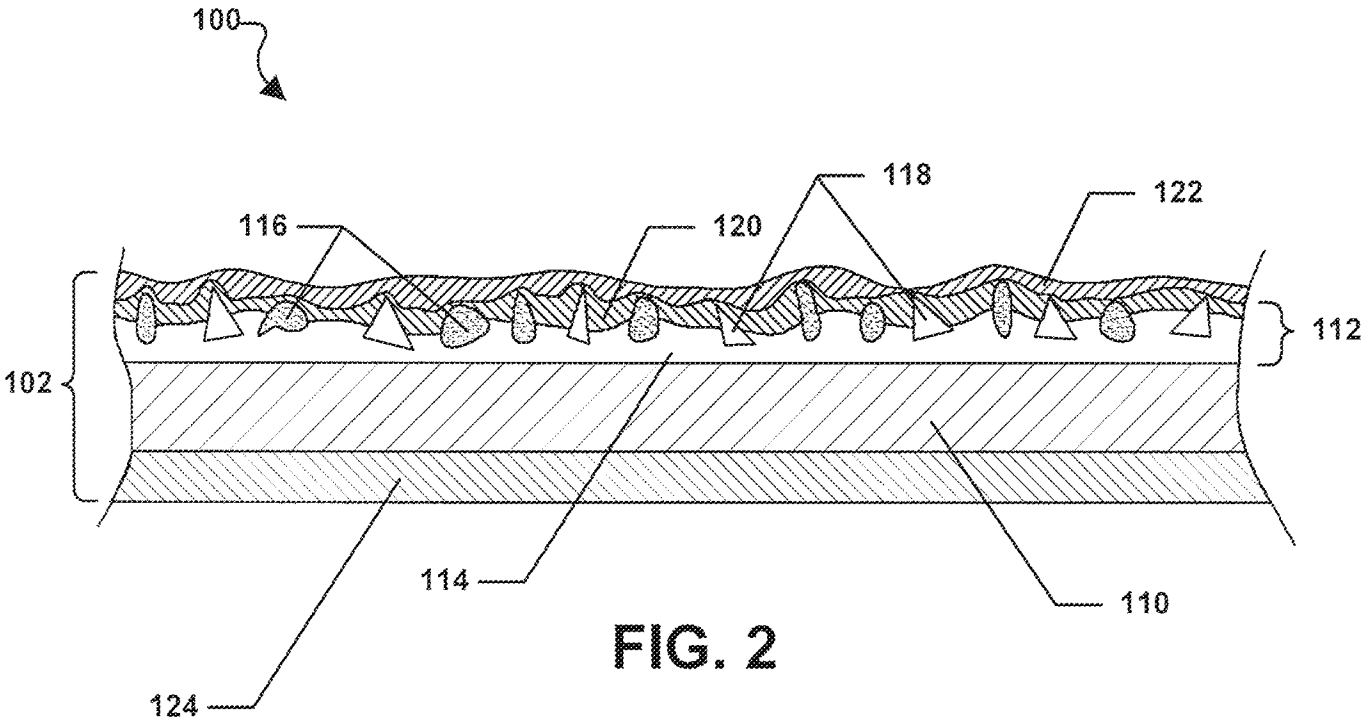
FIG. 2 is an illustration of a cross sectional view of an embodiment of a coated abrasive article that includes a blend of abrasive particles and increased tear resistance.

FIG. 2 shows an illustration of a cross section of the body 102 of the coated abrasive article 100 embodiment. As indicated in FIG. 2, the body 102 of the coated abrasive article can including a backing material 110 on which an abrasive layer 112 can be disposed. The abrasive layer 112 may include a polymeric binder layer 114 disposed on the backing material 110. Moreover, a first plurality of abrasive particles 116 and a second plurality of abrasive particles 118 may be dispersed on or in the polymeric binder layer 114. The first plurality of abrasive particles 116 is different than the second plurality of abrasive particles 118. Accordingly, the coated abrasive article 100 can include a blend of abrasive particles 116, 118, which will be described in greater detail herein.

Further, as indicated in FIG. 2, a size coat layer 120 can be disposed on the abrasive layer 112. A supersize coat layer 122 may be disposed on the size coat layer 120. In a particular embodiment, as indicated in FIG. 2, the body 102 of the coated abrasive article 100 may further include a tool attachment layer 124 disposed on a surface of the body 102 opposite the previously described layers, i.e., the abrasive layer 112, the size coat layer 120, and the supersize coat layer 122.

Figure 3:
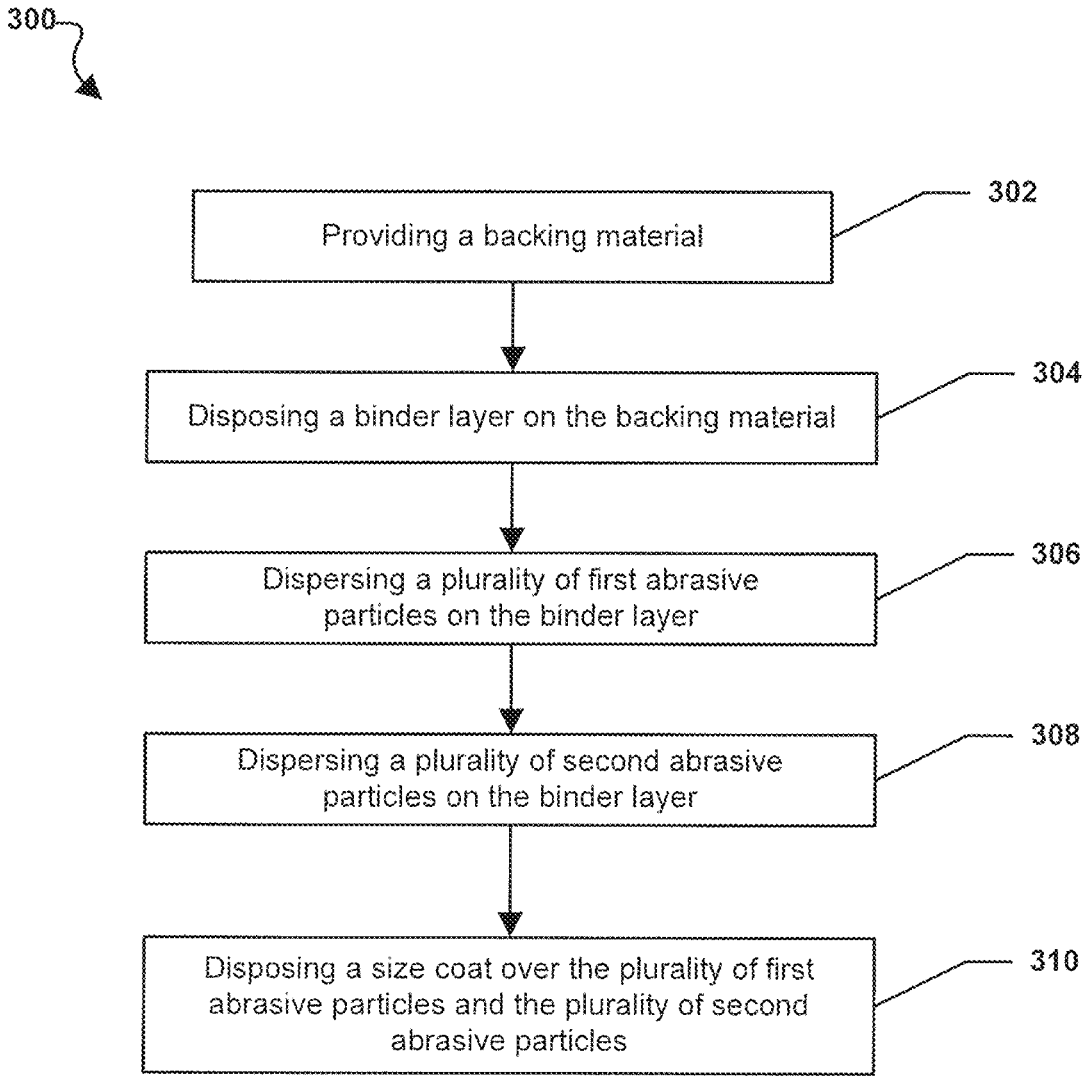
FIG. 3 is an illustration of a flowchart of an embodiment of a method of making a coated abrasive article having a blend of abrasive particles and increased tear resistance.

FIG. 3 is an illustration of a flowchart of an embodiment of a method 300 of making a coated abrasive article having a blend of abrasive particles and increased tear resistance. At step 302, the method 300 includes providing a backing material. At step 304, the method 300 includes disposing a binder layer on the backing material. Moving to step 306, the method includes dispersing a plurality of first abrasive particles on the binder layer. Further, at step 308, the method 300 includes dispersing a plurality of second abrasive particles on the binder layer. At step 310, the method 300 includes disposing a size coat over the plurality of first abrasive particles and the plurality of second abrasive particles.

Figure 4:
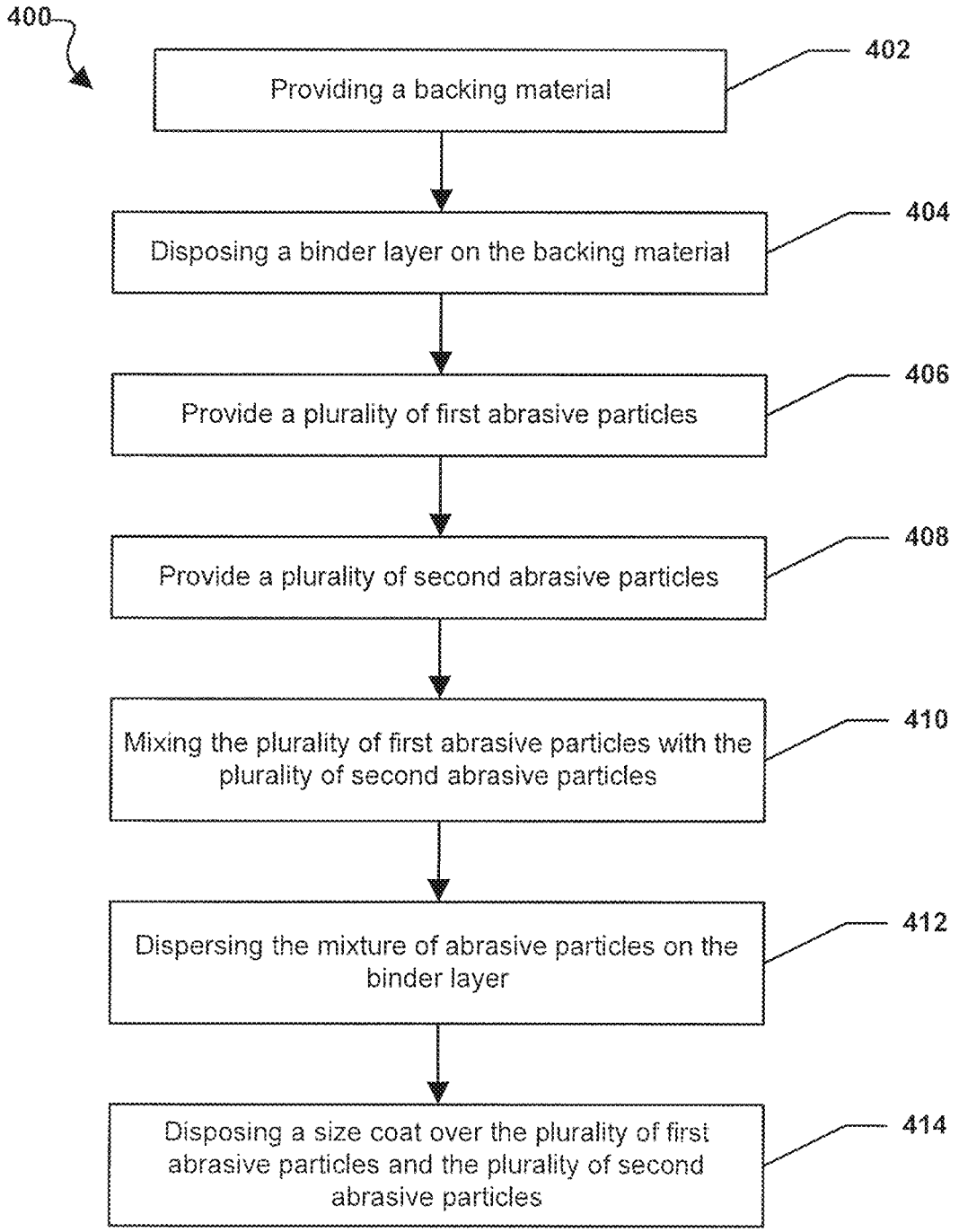
FIG. 4 is an illustration of a flowchart of another embodiment of a method of making a coated abrasive article having a blend of abrasive particles and increased tear resistance.

FIG. 4 is an illustration of a flowchart of another embodiment of a method 400 of making a coated abrasive article having a blend of abrasive particles and increased tear resistance. At step 402, the method 400 includes providing a backing material. At step 404, the method 300 includes disposing a binder layer on the backing material. Continuing to step 406, the method includes proving a plurality of first abrasive particles. At step 408, the method 400 includes providing a plurality of second abrasive particles. At step 410, the method 400 includes mixing the plurality of first abrasive particles with the plurality of second abrasive particles. Moving to step 412, the method 400 includes dispersing the mixture of abrasive particles on the binder layer. At step 414, the method 400 includes disposing a size coat over the plurality of first abrasive particles and the plurality of second abrasive particles.

Figure 5:
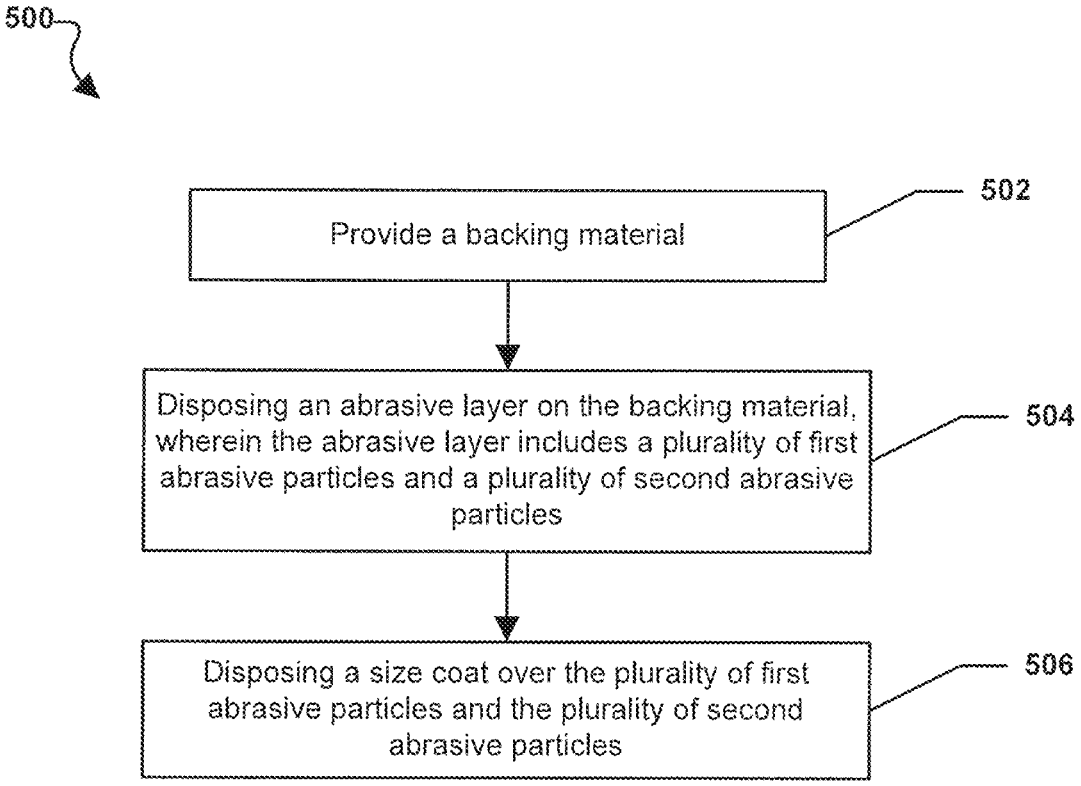
FIG. 5 is an illustration of a flowchart of yet another embodiment of a method of making a coated abrasive article having a blend of abrasive particles and increased tear resistance.

FIG. 5 is an illustration of a flowchart of still another embodiment of a method 500 of making a coated abrasive article having a blend of abrasive particles and increased tear resistance. At step 502, the method 500 includes providing a backing material. At step 504, the method 500 includes disposing an abrasive layer on the backing material. The abrasive layer includes a plurality of first abrasive particles and a plurality of second abrasive particles. Moving to step 506, the method 500 includes disposing a size coat over the plurality of first abrasive particles and the plurality of second abrasive particles.

Backing Material

In a particular embodiment, the backing material 110 (also referred to herein as "a backing") can be flexible or rigid. The backing 110 can be made of a suitable material having the proper combination of desired physical, chemical, mechanical, and/or performance properties and/or features to produce advantageous abrasive performance in combination with a blend of abrasive particles as described in greater detail herein. Suitable backing materials can include a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a chemically treated version thereof. Cloth backings can be woven or stitch bonded. In particular examples, the backing is selected from the group consisting of paper, polymer film, cloth (e.g., cotton, poly-cotton, rayon, polyester, poly-nylon), vulcanized rubber, vulcanized fiber, metal foil and a combination thereof.

The backing can optionally have at least one of a saturant, a presize layer (also called a "front fill layer"), or a backsize layer (also called a "back fill layer"). The purpose of these layers is typically to seal the backing or to protect yarn or fibers in the backing. If the backing is a cloth material, at least one of these layers is typically used. The addition of the presize layer or backsize layer can additionally result in a "smoother" surface on either the front or the back side of the backing. Other optional layers known in the art can also be used such as a tie layer.

In a particular embodiment, the backing material 110 can include a reinforced paper material in which a plurality of synthetic polymer fibers are mixed with paper pulp and processed into sheets.

Paper Backing

In an embodiment, the backing material is a paper backing. The paper can be a single ply paper or a multi-ply paper, such as a laminate paper. The paper can be saturated or unsaturated. The paper can be in the form of a sheet comprising a web of nonwoven fibers. The nonwoven web of fibers can comprise a single type of fibers (100%) or a blend of a plurality of types of fibers. The fibers can be natural fiber, synthetic fibers, a combination thereof, or a blend thereof. In a particular embodiment, a backing comprises a saturated, single ply, sheet of a nonwoven web that includes cellulosic fibers and synthetic fibers. Cellulosic fibers can be softwood cellulosic fibers, hardwood cellulosic fibers, or a combination thereof.

In an embodiment, the paper comprises at least about 80% by weight hardwood fibers, such that a saturated, cellulosic sheet (also called a base sheet herein) is generally formed from a nonwoven web comprising cellulosic fibers, with about 80 wt % to 100 wt % of the cellulosic fibers being hardwood fibers (based on the dried weight of the total cellulosic material in the nonwoven web), such as about 90 wt % to 100 wt % of the cellulosic fibers being hardwood fibers. The hardwood fibers can generally comprise chemical or mechanical pulp as known in the art.

In an embodiment, synthetic fibers are used in conjunction with the hardwood cellulosic fibers to increase the tear resistance of the fibrous web. The synthetic fibers can be formed of any suitable material and to any suitable size and shape as long as the resulting synthetic fibers serve as high tensile strength fibers. Examples of such synthetic fibers may include, for instance, polyolefins (e.g., polyethylene, polypropylene, polybutylene, etc.); polytetrafluoroethylene; polyesters (e.g., polyethylene terephthalate); polyvinyl acetate; polyvinyl chloride acetate; polyvinyl butyral; acrylic resins (e.g., polyacrylate, polymethylacrylate, polymethylmethacrylate etc.); polyamides (e.g., nylon 6, nylon 6/6, nylon 4/6, nylon 11, nylon 12, nylon 6/10, and nylon 12/12); polyvinyl chloride; polyvinylidene chloride; polystyrene; polyvinyl alcohol; polyurethanes; polylactic acid; and so forth.

In a particular embodiment, the synthetic fibers are polyester fibers, such as formed from a long-chain synthetic polymer composed of at least 85% by weight of an ester of a substituted aromatic carboxylic acid, including, but not restricted to, substituted terephthalate units and parasubstituted hydroxybenzoate units.

No matter the composition, the synthetic fibers generally have an average length that is long enough to add strength to the nonwoven web while being short enough for paper processing of the nonwoven web. For example, the synthetic fibers can have an average length that is about 0.25 inches to about 1.5 inches (e.g., about 0.5 inches to about 1 inch).

The fiber denier, however, may be adjusted to suit the capabilities of the finished article, though overall diameter of fibers used in most embodiments disclosed herein can generally be referred to as fine fibers. Fiber diameter may be measured and reported in a variety of fashions. Generally, fiber diameter is measured in denier per filament. Denier is a textile term which is defined as the grams of the fiber per 9000 meters of that fiber's length. Monofilament generally refers to an extruded strand having a denier per filament (dpf) greater than 25. Fine denier fiber generally refers to fiber having a denier of about 25 or less. Microfiber generally refers to fiber having a diameter not greater than about 100 micrometers. Fibers useful in embodiments disclosed herein may include fibers having a diameter corresponding to fine denier (e.g., about 3 dpf to about 25 dpf). In some embodiments, the fiber diameter may range from about 5 dpf to about 15 dpf.

The shape of the fiber is not limited. For example, in some embodiments the fibers may have a circular or elliptical cross-sectional shape. In other embodiments, the fibers may have different shapes, such as a trilobal shape, or a flat (i.e., "ribbon" like) shape.

The amount of synthetic fibers in the fibrous mixture can be controlled such that the resulting nonwoven web retains the paper properties of the cellulosic material with added strength from the synthetic fibers. For example, the fibrous mixture can contain about 4 wt % to about 20 wt % synthetic fibers (e.g., about 7 wt % to about 12 wt %) and about 80 wt % to about 96 wt % of cellulosic fibers (about 88 wt % to about 93 wt %), based on the dried weight of the resulting nonwoven web.

The nonwoven web can possess a particular "weight" (mass per unit area), such as $g/m^2$ (abbreviated herein as "GSM") useful for providing a paper backing ply sheet, such as from 10 GSM to 200 GSM. In an embodiment, the nonwoven web comprises a nonwoven web weight of not less than 100 GSM, such as not less than 110 GSM, not less than 115 GSM, not less than 120 GSM, not less than 125 GSM, or not less than 130 GSM. In an embodiment, the nonwoven web comprises a nonwoven web weight of not greater than 180 GSM, not greater than 175 GSM, such as not greater than 160 GSM, not greater than 155 GSM, or not greater than 150 GSM. The weight of the nonwoven web can be within a range comprising any pair of the previous upper and lower limits. In a particular embodiment, the weight of the nonwoven web can be in the range of not less than 100 GSM to not greater than 180 GSM, such as not less than 110 GSM to not greater than 170 GSM, not less than 120 GSM to not greater than 160 GSM, or not less than 130 GSM to not greater than 150 GSM.

The nonwoven web can have any thickness useful for providing a paper backing ply sheet, such as about 0.05 millimeters to about 1 millimeter.

In an embodiment, a saturating composition is applied onto or into the nonwoven web. The saturating composition can include a curable latex polymeric binder, a film forming resin, and optional additional components.

The amount of the saturating composition applied may vary depending on the desired properties of the web, such as the desired permeability. Typically, the saturating composition is present at an add-on level of about 10% to about 100%, and in some embodiments, from about 40% to about 80%. The add-on level is calculated by dividing the dry weight of the saturating composition applied by the dry weight of the web before treatment, and multiplying the result by 100.

In an embodiment, the saturated nonwoven web is calendered after saturation. Calendering the saturated nonwoven web can increase the softness and smoothness of the sheet.

A top coating may be applied, in certain embodiments, onto the nonwoven web. The top coating can be a film forming coating, a barrier coating, a semi-porous coating, etc. The top coating can be a barrier coating applied onto the nonwoven web following saturation.

Particularly suitable latex polymeric binders are those that adhere or bond well to the saturated, nonwoven web. For example, one particularly suitable latex polymeric binder for the barrier coating can include an acrylic latex binder.

The backing material can have a particular tear strength (Elmendorf tear strength) in the machine direction (MD tear strength). In an embodiment, the tear strength of the paper in the machine direction can be not less than 135 g force, not less than 150 g force, not less than 200 g force, not less than 250 g force, not less than 300 g force, or not less than 350 g force. In another embodiment, the tear strength of the paper in the machine direction can be not greater than 550 g force, not greater than 500 g force, not greater than 450 g force, or not greater than 400 g force. The tear strength of the paper can be within a range comprising any pair of the previous upper and lower limits. In a particular embodiment, the tear strength of the paper in the machine direction can be in a range of not less than 150 g force to not greater than 550 g force, such as 200 g force to 500 g force, such as 250 g force to 450 g force, or 300 g force to 400 g force.

The backing material can have a particular tear strength (Elmendorf tear strength) in the cross direction (CD tear strength). In an embodiment, the tear strength of the paper in the cross direction can be not less than 150 g force, not less than 200 g force, not less than 250 g force, not less than 300 g force, not less than 350 g force, or not less than 400 g force. In another embodiment, the tear strength of the paper in the cross direction can be not greater than 650 g force, not greater than 600 g force, not greater than 550 g force, or not greater than 500 g force. The tear strength of the paper can be within a range comprising any pair of the previous upper and lower limits. In a particular embodiment, the tear strength of the paper in the cross direction can be in a range of not less than 150 g force to not greater than 650 g force, such as 200 g force to 600 g force, such as 250 g force to 550 g force, or 300 g force to 500 g force.

The backing material can have a particular relationship of the tear strength (Elmendorf tear strength) in the cross direction (CD tear strength) compared to the tear strength (Elmendorf tear strength) in the machine direction (MD tear strength). In an embodiment, the tear strength in the cross direction (CD tear strength) is at least equal to the tear strength in the machine direction (MD tear strength). In another embodiment, the tear strength in the cross direction (CD tear strength) is greater than the tear strength in the machine direction (MD tear strength). The relationship of the CD tear strength to the MD tear strength can be expressed as a ratio or as a percentage.

In an embodiment, the ratio of MD tear strength to CD tear strength ($MD_{strength}$:$CD_{strength}$) of the backing material can vary. In an embodiment, the ratio $MD_{strength}$:$CD_{strength}$ can be not less than 1:4, not less than 1:3.5, not less than 1:3, or not less than 1:2.5. In another embodiment, the ratio $MD_{strength}$:$CD_{Strength}$ can be not greater than 1:1, such as not greater than 1:1.05, not greater than 1:1.1, or not greater than 1:1.15. The tear strength of the backing material can be within a range comprising any pair of the previous upper and lower limits. In a particular embodiment, the ratio $MD_{strength}$:$CD_{strength}$ can be in a range from 1:1 to 1:4, such as 1.1.05 to 1:4.

Figure 6:
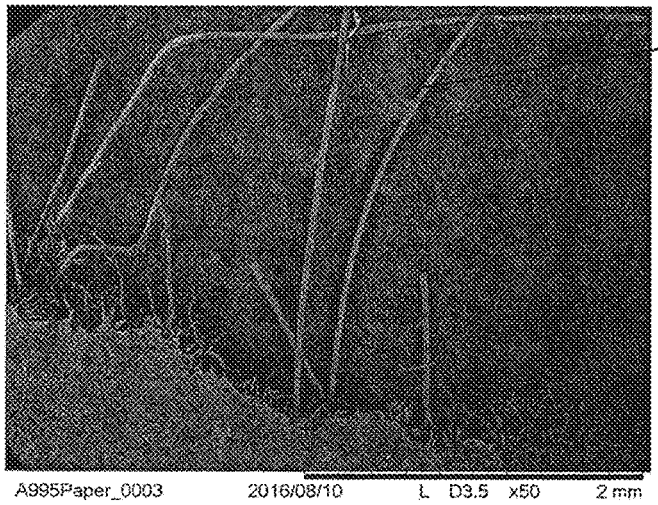
FIG. 6 is a scanning electron microscope (SEM) image of a backing material for a coated abrasive article having a blend of abrasive particles and increased tear resistance.
Figure 7:
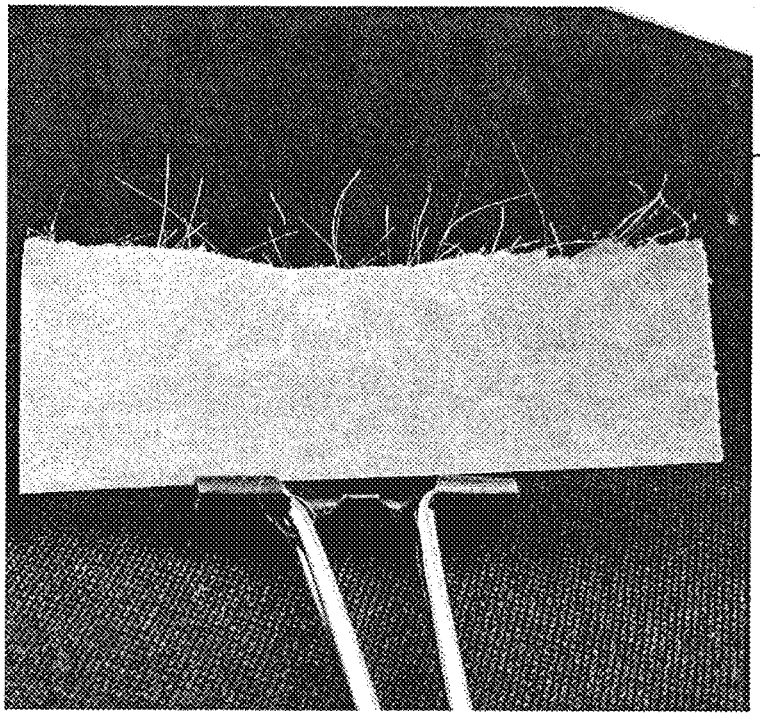
FIG. 7 is a photographic image of a backing material for a coated abrasive article having a blend of abrasive particles and increased tear resistance.

FIG. 6 and FIG. 7 show images of sample backing materials. Specifically, FIG. 6 is a scanning electron microscope (SEM) image of a backing material 600 taken at fifty times (50×) magnification. As shown in FIG. 6, the backing material 600 is torn to show a plurality of fibers 602, e.g., a plurality of polyester fibers, present within a paper material 604. FIG. 7 is a close-up photographic image of a backing material 700 with no magnification. FIG. 7 also shows that the backing material 700 is torn to show a plurality of fibers 702, e.g., polyester fibers, within a paper material 704. In either sample, the fibers 602, 702 reinforce and strengthen the backing material 600, 700 and provide increased tear strength when compared to current state-of-the-art backing materials. Comparison testing data is provided in detail below. In this particular aspect, the samples shown in the images of FIG. 6 and FIG. 7 included a basis weight of 150.8 grams per square meter (gsm). The samples were tested and included have a machine direction (MD) tear strength of 300 grams (average for 16 individual sheets tested). Further, the samples were tested and included a cross-direction (CD) tear strength of 350 grams (average for 16 individual sheets tested).

Abrasive Layer

As described above, the abrasive layer 112 includes the first plurality of abrasive particles 116 and the second plurality of abrasive particles 118 disposed on, or dispersed in, the polymeric binder layer 114 composition.

Abrasive Particles

Abrasive particles can include essentially single phase inorganic materials, such as alumina, silicon carbide, silica, ceria, and harder, high performance superabrasive particles such as cubic boron nitride and diamond. Additionally, the abrasive particles can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

In an embodiment, the abrasive particles are blended with the binder formulation to form abrasive slurry. Alternatively, the abrasive particles are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive particles can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive particles can have an average particle size not greater than 2000 microns, such as not greater than about 1500 microns, not greater than about 1000 microns, not greater than about 750 microns, or not greater than 500 microns. In another embodiment, the abrasive particle size is at least 0.1 microns, at least 1 microns, at least 5 microns, at least 10 microns, at least 25 microns, or at least 45 microns. In another embodiment, the abrasive particles size is from about 0.1 microns to about 2000 microns, such as about 50 microns to about 1000 microns, about 100 microns to about 500 microns, about 125 microns to about 275 microns. The particle size of the abrasive particles is typically specified to be the longest dimension of the abrasive particle. Generally, there is a range distribution of particle sizes. In some instances, the particle size distribution is tightly controlled.

The plurality of abrasive particles can comprise a blend of particular types of abrasive particles.

Fusion Particles

The blend can include can comprise aluminum oxide abrasive particles produced by a fusion process (commonly known as "ALO" abrasive particles or "fused aluminum oxide" abrasive particles). ALO abrasive particles include alumina zirconia fusion abrasive particles, Brown friable aluminum oxide abrasive particles, semi-friable aluminum oxide abrasive particles, and white friable aluminum oxide abrasive particles. ALO abrasive particles can be heat treated to alter the physical and abrasive performance properties of the abrasive particles. Such heated treated ALO abrasive particles are commonly referred to as "heat treated" versions of the particles (e.g., heat treated brown friable aluminum oxide abrasive particles).

In an embodiment, the plurality of abrasive particles comprises an aluminum oxide fusion process abrasive particle. In a particular embodiment, the plurality of abrasive particles comprises brown aluminum oxide abrasive particles, semi-friable aluminum oxide abrasive particles, white aluminum oxide abrasive particles, heat treated versions thereof, or combinations thereof.

Ceramic Particles

The blend can comprise ceramic abrasive particles, such as ceramic aluminum oxide abrasive particles. Ceramic aluminum oxide abrasive particles (also called sol-gel aluminum oxide) are produced by sol-gel formation processes. Sol-gel processes include seeded gel alumina formation processes. Seeded gel alumina abrasive particles are ceramic aluminum oxide particles manufactured by a sintering process and have a very fine microstructure. Each abrasive particle is composed of sub-micron size sub-particles (micro to nano sized primary particles of alumina) that under grinding force are separated off from the larger secondary abrasive particle. Seeded-gel abrasive particles tend to stay sharper than conventional abrasive particles, which can dull as flats are worn on the working points of the abrasive grits. Ceramic aluminum oxide particles include ceramic aluminum oxide shaped abrasive particles, ceramic aluminum oxide crushed abrasive particles, and ceramic aluminum oxide exploded particles.

Ceramic abrasive particles can be doped ceramic abrasive particles or undoped (i.e., not doped) ceramic abrasive particles. In an embodiment, the ceramic abrasive particles are undoped ceramic abrasive particles. In another embodiment, the ceramic abrasive particles are doped abrasive particles. Doped abrasive particles can be doped in vary amounts. In an embodiment, the dopant can comprise 0.1 wt % to 3.0 wt % of the ceramic abrasive particles, such as from 0.5 wt % to 1.5 wt % of a dopant. Dopant compounds can comprise various metal oxides, such as magnesium oxide (MgO). In an embodiment, the dopant comprises MgO, such as 0.5 wt % to 1.5 wt % MgO.

Number of Pluralities of Abrasive Particles

The total number of pluralities of abrasive grains (types of abrasive grains) in abrasive blends of the present disclosure is not particularly limited, and can include up to "n" pluralities of abrasive grains. For example, embodiments of the present disclosure include abrasive blends having at least two pluralities of abrasive grains, such as at least three pluralities of abrasive grains, at least four pluralities of abrasive grains, at least five pluralities of abrasive grains, at least six pluralities of abrasive grains, at least seven pluralities of abrasive grains or . . . at least "n" pluralities of abrasive grains.

In a specific embodiment, the abrasive particles are a blend of abrasive particles, such as a blend of ceramic aluminum oxide abrasive particles and a fusion process aluminum oxide abrasive particles. In a particular embodiment, the abrasive particles comprise a blend of exploded ceramic aluminum oxide abrasive particles and semi-friable aluminum oxide aluminum oxide abrasive particles.

Ratios

Abrasive blend embodiments of the present disclosure may also be defined by various ratios or ratio relationships the pluralities of abrasive grains, within each abrasive blend. In particular, the ratios of grains for abrasive blends described herein, whether comprising two, three, four, five, six, seven, or . . . "n" pluralities of abrasive grains is not particularly limited. For example, for abrasive blends having two pluralities of abrasive grains, the ratio of the amount of the first plurality of abrasive grains to the second plurality of abrasive grains can be written as: x:y, where x represents the amount of the first plurality of abrasive grains in the blend; y represents the amount of the second plurality of abrasive grains in the blend; and x and y are defined within a set of any positive integer value greater than zero. For abrasive blends having three pluralities of abrasive grains, the ratio of the amount of the first plurality of abrasive grains to the second and the third pluralities of abrasive grains can be written as: x:y:z, where x represents the amount of the first plurality of abrasive grains in the blend; y represents the amount of the second plurality of abrasive grains in the blend; z represents the amount of the third plurality of abrasive grains in the blend; and x, y and z are defined within a set of any positive integer value greater than zero. The same can be repeated for up to "n" plurality of abrasive grains.

In abrasive blend ratios of the present disclosure, x, y, z . . . n, as described above, can be any one of a set of positive integer values greater than zero. In certain embodiments, x, y, z . . . n can all be different values. In other embodiments, any one and up to all x, y and z . . . n can be identical values.

For example, in embodiments where the abrasive blend comprises two pluralities of abrasive grains, such as a first plurality of abrasive grains and a second plurality of abrasive grains, the abrasive blend may comprise a grain ratio between the first plurality of abrasive grains and the second plurality of abrasive grains ranging from 1:10, such as from 1:9, from 1:8, from 1:7, from 1:6, from 1:5, from 1:4, from 1:3, 1:2; or from 1:1, and vice versa with respect to a grain ratio between the second plurality of abrasive grains and the first plurality of abrasive grains for each of the aforementioned ratio values.

In certain embodiments where the abrasive blend comprises two pluralities of abrasive grains, the abrasive blend may comprise a grain ratio between the first plurality of abrasive grains and the second plurality of abrasive grains of 2:3, or 2:5, or 2:7, or 2:9; and vice versa with respect to a grain ratio between the second plurality of abrasive grains and the first plurality of abrasive grains for each of the aforementioned ratio values.

In embodiments where the abrasive blend comprises three pluralities of abrasive grains, the abrasive blend may comprise a grain ratio between the first plurality of abrasive grains and the second plurality of abrasive grains ranging from 1:10, such as from 1:9, from 1:8, from 1:7, from 1:6, from 1:5, from 1:4, from 1:3, 1:2; or from 1:1 and vice versa with respect to a grain ratio between the second plurality of abrasive grains and the first plurality of abrasive grains for each of the aforementioned ratio values.

In certain embodiments where the abrasive blend comprises three pluralities of abrasive grains, the abrasive blend may comprise a grain ratio between the first plurality of abrasive grains and the second plurality of abrasive grains of 2:3, or 2:5, or 2:7, or 2:9; and vice versa with respect to a grain ratio between the second plurality of abrasive grains and the first plurality of abrasive grains for each of the aforementioned ratio values.

In certain embodiments where the abrasive blend comprises three pluralities of abrasive grains, the abrasive blend may comprise a grain ratio between the first plurality of abrasive grains, the second plurality of abrasive grains, and the third plurality of abrasive grains of from 1:5:10, and all values between, such as from 1:5:9, from 1:5:8, from 1:5:7, from 1:2:10, from 1:3:10, from 1:4:10, from 2:5:10 from 2:5:9, from 2:4:8, from 2:4:7, from 2:5:7, from 3:5:10, from 3:5:9, from 3:5:7, from 3:5:7, from 3:5:5, from 1:3:3, from 1:2:3, from 1:1:10, from 1:1:5, from 1:1:2, from 1:1:1, or from 2:2:5.

In particular embodiments where the abrasive blend comprises three pluralities of abrasive grains, the abrasive blend may comprise a grain ratio between the first plurality of abrasive grains, the second plurality of abrasive grains, and the third plurality of abrasive grains of 2:3:3.

In embodiments where the abrasive blend comprises two or more pluralities of abrasive grains, the first plurality of abrasive grains (this may apply for two, three, four or five plurality of abrasive grain blends) may be present in an amount that is at least twice the amount of the second abrasive grain in the abrasive grain blend. Alternatively, in the first abrasive grain and the second abrasive grain may be present in equal amounts in the abrasive blend.

In embodiments where the abrasive blend comprises three or more pluralities of abrasive grains, the second plurality of abrasive grains may be present in an amount that is at least twice the amount of the third plurality of abrasive grains in the abrasive blend. Alternatively, the first plurality of abrasive grains, the second plurality of abrasive grains and the third plurality of abrasive grains may be present in equal amounts in the abrasive blend.

In embodiments where the abrasive blend comprises three or more pluralities of abrasive grains, the third plurality of abrasive grains may be present in an amount that is at least twice the amount of the plurality of first abrasive grains.

In abrasive blend embodiments, the second plurality of abrasive grains may be present in an amount of no greater than ten times the amount of the first plurality of abrasive grains, and vice versa between the first plurality of abrasive grains and the second plurality of abrasive grains. Moreover, in embodiments where the abrasive blend comprises three or more pluralities of abrasive grains, the first plurality of abrasive grains is present in an amount of no greater than ten times the amount of the third plurality of abrasive grains, and vice versa between the first plurality of abrasive grains and the third plurality of abrasive grains.

It will be appreciated that the grain ratios (whether with respect to the first plurality of abrasive grains and the second plurality of abrasive grains; the second plurality of abrasive grains with respect to the third plurality of abrasive grains; the first plurality of abrasive grains with respect to the third plurality of abrasive grains; the first plurality of abrasive grains with respect to the second and third plurality of abrasive grains; or the first plurality of abrasive grains with respect to the second and fourth plurality of abrasive grains, and the like) is not particularly limiting and the above described ratios and amounts are intended to encompass all vice versa scenarios, and all range amounts between the ratios and/or amounts described above; and may also be applied to different combinations of first, second, third, fourth and/or fifth plurality of abrasive grains, and any combinations or multiple ratios thereof, not specifically listed herein.

It will be appreciated that the above-described grain ratios and amounts of grains with respect to other grains in a grain blend are not intended to be limiting, and that the above-described illustrative ratios.

In a particular embodiment, the first plurality of abrasive particles 116 can include ceramic aluminum oxide abrasive particles, which can be unexploded ceramic aluminum oxide particles or exploded ceramic aluminum oxide abrasive particles or a combination thereof. The ceramic aluminum oxide particles can include a dopant. In a specific embodiment, the first plurality of abrasive particles 116 can include high performance exploded ceramic aluminum oxide abrasive particles. In a particular aspect, the abrasive particles are not doped. In another aspect, the abrasive particles are doped with an amount of MgO, which can range from 0.1 wt % to 3 wt %, such as 0.5 wt % to 1.5 wt %, such as about 1 wt %. In one aspect, exploded ceramic abrasive particles made using an explosion process that gives the particles extremely sharp edges that remain sharp relatively longer than comparable abrasive particles.

The second plurality of abrasive particles 118 can include semi-friable aluminum oxide particles, such as a heat treated semi-friable brown aluminum oxide particles. In a particular aspect, the particles can be crushed abrasive particles formed using a crushing process. In particular, the particles can be formed using a roller crushing process, which tends to produce a higher aspect ratio for the abrasive particles, as well as beneficial fracture properties.

In a particular aspect, the first plurality of abrasive particles 116 may be present in the mixture of the first plurality of abrasive particles 116 and the second plurality of abrasive particles 118 in an amount greater than or equal to 25 wt %. In another aspect, the first plurality of abrasive particles 116 are present in an amount greater than or equal to 30 wt %, such as greater than or equal to 35 wt %, greater than or equal to 40 wt %, greater than or equal to 45 wt %, or greater than or equal to 50 wt %. In yet another aspect, the first plurality of abrasive particles 116 are present in the mixture in an amount less than or equal to 75 wt %. In particular, the first plurality of abrasive particles 116 are present in an amount less than or equal to 70 wt %, such as less than or equal to 65 wt %, less than or equal to 60 wt %, less than or equal to 55% wt, or less than or equal to 50 wt %.

In another aspect, the second plurality of abrasive particles 118 may be present in the mixture of the first plurality of abrasive particles 116 and the second plurality of abrasive particles 118 in an amount less than or equal to 75 wt %. In another aspect, the second plurality of abrasive particles 118 are present in an amount less than or equal to 70 wt %, such as less than or equal to 65 wt %, less than or equal to 60 wt %, less than or equal to 55 wt %, or less than or equal to 50 wt % In yet another aspect, the second plurality of abrasive particles 118 are present in the mixture in an amount greater than or equal to 25 wt % In particular, the second plurality of abrasive particles 118 are present in an amount greater than or equal to 30 wt %, such as greater than or equal to 35 wt %, greater than or equal to 40 wt %, greater than or equal to 45% wt, or greater than or equal to 50 wt %.

In a particular aspect, the first plurality of abrasive particles 116 and the second plurality of abrasive particles 118 are present in the mixture of the first plurality of abrasive particles 116 and the second plurality of abrasive particles at a ratio of 1:3. In another particular aspect, the first plurality of abrasive particles 116 and the second plurality of abrasive particles 118 are present in the mixture of the first plurality of abrasive particles 116 and the second plurality of abrasive particles at a ratio of 1:1. In yet another particular aspect, the first plurality of abrasive particles 116 and the second plurality of abrasive particles 118 are present in the mixture of the first plurality of abrasive particles 116 and the second plurality of abrasive particles 118 at a ratio of 3:1.

Figure 8:
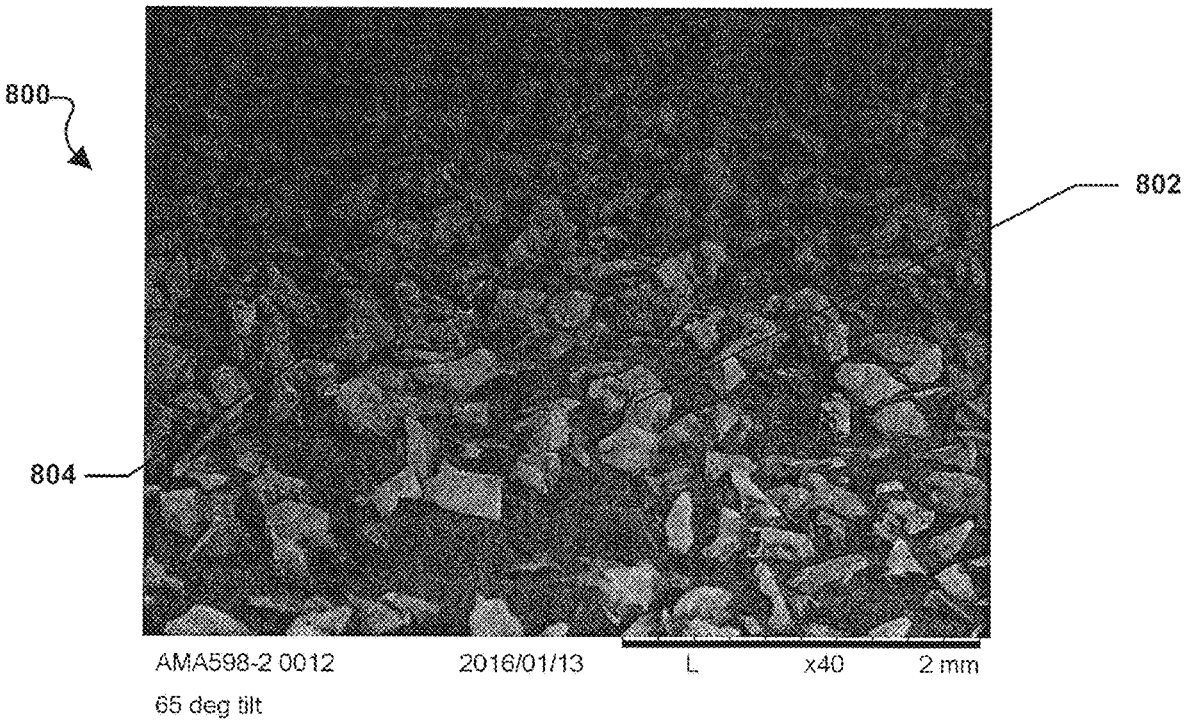
FIG. 8 is an SEM image of a coated abrasive article having a blend of abrasive particles and increase tear resistance.
Figure 9:
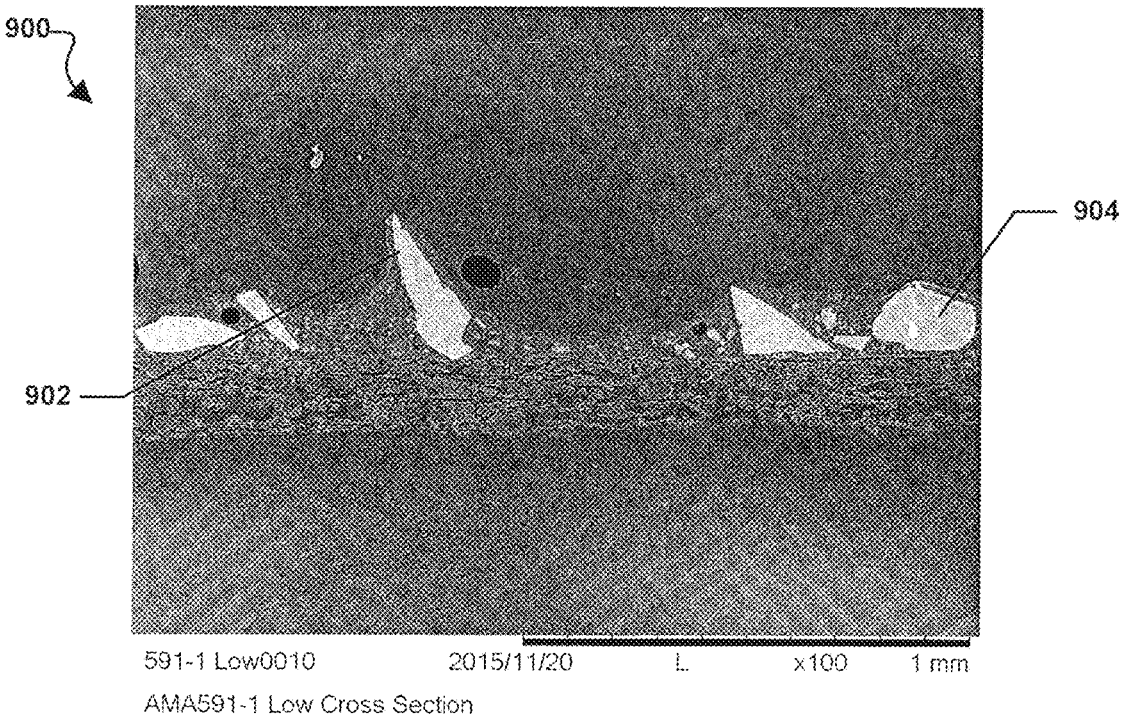
FIG. 9 is an SEM image of a coated abrasive article having a blend of abrasive particles and increase tear resistance.

FIG. 8 and FIG. 9 are SEM images of two samples of a coated abrasive article taken prior to a size coat layer being disposed on the abrasive particles. FIG. 8 is an SEM image at forty times (40×) magnification taken at 65° of tilt. FIG. 8 shows that the coated abrasive article 800 includes a mixture of abrasive particles. Specifically, the coated abrasive article 800 includes a first plurality of abrasive particles 802 and a second plurality of abrasive particles 804. As described herein, the first plurality of abrasive particles 802 are exploded abrasive particles and have very sharp edges. Further, as described herein, the second plurality of abrasive particles 804 are crushed abrasive particles 804.

FIG. 9 is an SEM image at one hundred times (100×) magnification taken at low, nearly cross-sectional angle. FIG. 9 shows that this sample of a coated abrasive article 900 includes a mixture of abrasive particles. Specifically, the coated abrasive article 900 includes a first plurality of abrasive particles 902 and a second plurality of abrasive particles 904. As described herein, the first plurality of abrasive particles 902 are exploded abrasive particles and have very sharp edges. Further, as described herein, the second plurality of abrasive particles 904 are crushed abrasive particles 904. In each sample, the mixture of the two types of abrasive particles has shown through testing, described below, to provide enhance material removal during abrasion procedures along with enhanced life of the coated abrasive article.

Binder Layer

In a particular aspect, the binder layer 114 (commonly known as the make coat) can be formed of a single polymer or a blend of polymers. The binder composition can be formed from an epoxy composition, acrylic composition, a phenolic composition, a polyurethane composition, a urea formaldehyde composition, a polysiloxane composition, or combinations thereof. In addition, the binder composition can include active filler particles, additives, or a combination thereof, as described herein.

The binder composition generally includes a polymer matrix, which binds abrasive particles to the backing or to a compliant coat, if such a compliant coat is present. Typically, the binder composition is formed of cured binder formulation. In an embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

In an embodiment, the make coat comprises no filler particles. In an embodiment, the make coat comprises a urea formaldehyde composition and no filler particles. In another embodiment, the make coat comprises filler particles. In a specific embodiment, the make coat comprises a urea formaldehyde composition and filler particles. In another specific embodiment, the make coat comprises a urea formaldehyde composition, filler particles, and an additive. The relative amounts of the make coat components can vary. In an embodiment, the amount of polymer resin, such as a urea formaldehyde resin, can be not less than 30 wt % of the make coat, such as not less than 35 wt %, not less than 40 wt %, not less than 45 wt %, not less than 50 wt %, not less than 55 wt %, not less than 60 wt %, or not less 65 wt %. In an embodiment, the amount of polymer resin, can be not greater than 100 wt % of the make coat, such as not greater than 95 wt %, not greater than 90 wt %, not greater than 85 wt %, not greater than 80 wt %, not greater than 75 wt %, not greater than 70 wt %, or not greater than 65 wt %. The amount of polymer resin can be within a range comprising any pair of the previous upper and lower limits. In an embodiment, the amount of polymer resin in the make coat can be not less than 30 wt % to not greater than 100 wt %, such as about 30 wt % to 85 wt %, such as 30 wt % to 75 wt %, or such as 45 wt % to 85 wt %, such as 45 wt % to 75 wt %, or such as 55 wt % to 85 wt %, or such as 55 wt % to 75 wt %.

In an embodiment, the amount of filler particles is 0 wt % (no filler particles). In another embodiment, filler particles are present and the amount can vary. In an embodiment, the amount of filler particles in the make coat can be not less than 1 wt % of the make coat, such as not less than 5 wt %, not less than 10 wt %, not less than 15 wt %, not less than 20 wt %, not less than 25 wt %, not less than 30 wt %, or not less 35 wt %. In an embodiment, the amount of filler particles can be not greater than 60 wt % of the make coat, such as not greater than 55 wt %, not greater than 50 wt %, not greater than 45 wt %, not greater than 40 wt %, or not greater than 35 wt %. The amount of filler particles can be within a range comprising any pair of the previous upper and lower limits. In an embodiment, the amount of filler particles in the make coat can be not less than 1 wt % to not greater than 60 wt %, such as about 5 wt % to 55 wt %, such as 10 wt % to 50 wt %, such as 10 wt % to 45 wt %, or such as 15 wt % to 45 wt %, or such as 20 wt % to 40 wt %.

In a particular embodiment, the make coat comprises about 30 wt % to 75 wt % of a urea formaldehyde composition, and about 10 wt % to 45 wt % of filler particles. In another particular embodiment, the make coat comprises about 30 wt % to 75 wt % of a urea formaldehyde composition and about 10 wt % to 45 wt % of calcium sulfate ($CaSO_4$), also known as gypsum, filler particles.

In a particular aspect, the binder layer 114 can include: approximately 55-75 wt % of urea formaldehyde resin and approximately 20-35 wt % of calcium sulfate solid filler.

Size Coat Layer

As described above, the coated abrasive article 100 can comprise a size coat layer 120 disposed on the abrasive layer 112. The size coat layer 120 can be the same as or different from the polymer binder layer 114 of the abrasive layer 112 (i.e., the size coat composition can be the same as or different than the make coat composition). In an embodiment, the size coat layer 120 can comprise any conventional compositions known in the art that can be used as a size coat layer 120. The size coat layer 120 can include one or more fillers, additives, or a combination thereof.

In a specific embodiment, the size coat layer 120 can include no active filler particles. In another embodiment, the size coat layer 120 can include a urea formaldehyde composition. In another embodiment, the size coat layer 120 can include a urea formaldehyde composition and an additive. In a specific embodiment, the size coat layer 120 can include about 30 to 75 wt % of a urea formaldehyde composition and about 10 wt % to 45 wt % of calcium sulfate.

In a particular aspect, the size coat layer 120 can include: approximately 55-75 wt % of urea formaldehyde resin and approximately 20-35 wt % of calcium sulfate solid filler.

Supersize Coat Layer

As previously described, the coated abrasive article 100 can comprise a supersize coat layer 122 disposed on the size coat layer 120. The supersize coat layer 122 can be the same as or different from the polymeric binder layer 114 of the abrasive layer 112 and can be same s or different than the size coat layer 120 disposed thereon. In another aspect, the supersize coat layer 122 may comprise an anti-loading agent, such as a stearate, such as a metal stearate, such as zinc stearate or calcium stearate.

The relative amounts of the supersize coat components can vary. In an embodiment, the amount of polymer resin, such as a self-crosslinking acrylic resin is 0 wt % (no polymer resin). In another embodiment, a polymer resin is present and the amount can vary. In an embodiment, the amount of polymer resin, such as a self-crosslinking acrylic resin, can be not less than 0.5 wt % of the supersize coat, such as not less than 1 wt %, not less than 2 wt %, not less than 3 wt %, not less than 4 wt %, not less than 5 wt %, or not less 7 wt %. In an embodiment, the amount of polymer resin, can be not greater than 50 wt % of the supersize coat, such as not greater than 45 wt %, not greater than 40 wt %, not greater than 35 wt %, not greater than 30 wt %, not greater than 25 wt %, not greater than 20 wt %, not greater than 15 wt %, or not greater than 10 wt %. The amount of polymer resin can be within a range comprising any pair of the previous upper and lower limits. In an embodiment, the amount of polymer resin in the supersize coat can be not less than 0.5 wt % to not greater than 50 wt %, such as about 0.5 wt % to 35 wt %, such as 0.5 wt % to 25 wt %, such as 0.5 wt % to 15 wt %, or such as 1 wt % to 10 wt %.

In an embodiment, the supersize coat can include an anti-loading agent. In an embodiment, the anti-loading agent can include a metal stearate. In an embodiment the metal stearate can include a zinc stearate, a calcium stearate, a lithium stearate, blends thereof, and any combination thereof. In an embodiment, an anti-loading agent is present in the supersize coat and the amount can vary. In an embodiment, the amount of anti-loading agent in the supersize coat can be not less than 50 wt % of the supersize coat, such as not less than 55 wt %, not less than 60 wt %, or not less than 70 wt %. In an embodiment, the amount of anti-loading agent can be not greater than 100 wt % of the supersize coat, such as not greater than 99 wt %, not greater than 98%, not greater than 97 wt %, not greater than 96 wt %, not greater than 95 wt %, not greater than 90 wt %, not greater than 80 wt %, or not greater than 75 wt %. The amount of anti-loading agent can be within a range comprising any pair of the previous upper and lower limits. In an embodiment, the amount of anti-loading agent in the supersize coat can be not less than 50 wt % to not greater than 100 wt %, such as about 55 wt % to 99 wt %, such as 60 wt % to 99 wt %, such as 70 wt % to 99 wt %.

In a particular aspect, the supersize coat layer 122 can include: approximately 35-55 wt % of a first zinc stearate, approximately 35-55 wt % of a second zinc stearate and approximately 5-30 wt % of an acrylic binder.

Additives

In a particular aspect, the binder layer 114 (also called herein the make coat layer), the size coat layer 120, or the supersize coat layer 122 can include one or more additives. Additives can be available in an amount of 0 wt % to 10 wt % of any polymer layer (i.e., make coat layer, size coat layer, or supersize layer). Suitable additives, for example, can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives can be present in any part of the overall system of the coated abrasive product according to embodiments of the present disclosure. Suitable grinding aids can be inorganic based; such as halide salts, for example cryolite, wollastonite, and potassium fluoroborate; or organic based, such as sodium lauryl sulphate, or chlorinated waxes, such as polyvinyl chloride. In an embodiment, the grinding aid can be an environmentally sustainable material.

Tool Attachment Layer

The abrasive article can optionally include a tool attachment layer. In a particular embodiment, the coated abrasive article 100 includes a tool attachment layer 124 that can be used to removably engage the coated abrasive article 100 with a tool, such as a random orbit rotary sander. The tool attachment layer 124 can include an adhesive.

In another aspect, the tool attachment layer 124 can include a mechanical fastener. For example, the mechanical fastener can include a hook fastener, a loop fastener, or a combination thereof that is configured to removably engage with a corresponding mechanical fastener on the tool on which the coated abrasive article 100 is intended to be disposed during abrasive operations.

EMBODIMENTS

Embodiment 1

A coated abrasive article comprising:
a backing material;
an abrasive layer disposed on the backing material, wherein the abrasive layer comprises a blend of abrasive particles comprising:
a first plurality of abrasive particles; and
a second plurality of abrasive particles,
wherein the first plurality of abrasive particles comprise exploded ceramic abrasive particles and the second plurality of abrasive particles comprise crushed fusion abrasive particles,
wherein the backing material comprises a fibrous mixture of a plurality of cellulosic fibers and a plurality of synthetic fibers, and wherein the backing material comprises a tear strength in the cross direction that is at least equal to the tear strength in the machine direction.

Embodiment 2

The coated abrasive article of embodiment 1, wherein the exploded ceramic abrasive particles comprise exploded ceramic aluminum oxide abrasive particles.

Embodiment 3

The coated abrasive article of embodiment 2, wherein the exploded ceramic aluminum oxide abrasive particles further comprise a dopant.

Embodiment 4

The coated abrasive article of embodiment 3, wherein the dopant is magnesium oxide.

Embodiment 5

The coated abrasive article of embodiment 4, wherein the dopant is present in an amount not greater than 3.0 wt %.

Embodiment 6

The coated abrasive article of embodiment 5, wherein the dopant is present in an amount not less than 0.1 wt %.

Embodiment 7

The coated abrasive article of embodiment 1, wherein the crushed fusion abrasive particles comprise crushed fusion semi-friable aluminum oxide particles.

Embodiment 8

The coated abrasive article of embodiment 7, wherein the crushed fusion aluminum oxide semi-friable abrasive particles comprise heat treated particles.

Embodiment 9

The coated abrasive article of embodiment 10, wherein the backing material comprises a ratio of tear strength in a machine direction to tear strength in a cross direction ($MD_{strength}$:$CD_{Strength}$) in a range from 1:1 to 1:4.

Embodiment 10

The coated abrasive article of embodiment 1, wherein the backing material comprises a tear strength in the machine direction of at least 150 g force.

Embodiment 11

The coated abrasive article of embodiment 1, wherein the backing material comprises a tear strength in the cross direction of at least 150 g force.

Embodiment 12

The coated abrasive article of embodiment 1, wherein the plurality of synthetic fibers comprises a polyolefin; a polytetrafluoroethylene; a polyester; a polyvinyl acetate; a polyvinyl chloride acetate; a polyvinyl butyral; an acrylic resin; a polyamide; a polyvinyl chloride; a polyvinylidene chloride; a polystyrene; a polyvinyl alcohol; a polyurethane; a polylactic acid; or a combination thereof.

Embodiment 13

The coated abrasive article of embodiment 1, wherein the cellulosic fibers comprise hardwood fibers.

Embodiment 14

The coated abrasive article of embodiment 12, wherein the fibrous mixture comprises about 4 wt % to about 20 wt % synthetic fibers.

Embodiment 15

The coated abrasive article of embodiment 1, wherein the fibrous mixture comprises about 80 wt % to about 96 wt % of cellulosic fibers.

Embodiment 16

The coated abrasive article of embodiment 1, wherein the synthetic fibers have an average length that is about 0.25 inches to about 1.5 inches.

Embodiment 17

The coated abrasive article of embodiment 1, wherein the first plurality of abrasive particles and the second plurality of abrasive particles are present in the abrasive layer at a ratio of 1:3.

Embodiment 18

The coated abrasive article of embodiment 1, wherein the first plurality of abrasive particles and the second plurality of abrasive particles are present in the abrasive layer at a ratio of 1:1.

Embodiment 19

The coated abrasive article of embodiment 1, wherein the first plurality of abrasive particles and the second plurality of abrasive particles are present in the abrasive layer at a ratio of 3:1.

Embodiment 20

The coated abrasive article of embodiment 1, wherein the first plurality of abrasive particles is present in an amount greater than or equal to 25 wt %.

Embodiment 21

The coated abrasive article of embodiment 12, wherein the first plurality of abrasive particles are present in an amount less than or equal to 75 wt %.

Embodiment 22

The coated abrasive article of embodiment 1, wherein the second plurality of abrasive particles are present in an amount less than or equal to 75 wt %.

Embodiment 23

The coated abrasive article of embodiment 22, wherein the second plurality of abrasive particles is present in an amount greater than or equal to 25 wt %.

Embodiment 24

A method of making a coated abrasive article comprising:
disposing an abrasive layer on a backing material,
wherein the backing material comprises a fibrous mixture of a plurality of cellulosic fibers and a plurality of synthetic fibers,
wherein the backing material comprises a tear strength in the cross direction that is at least equal to the tear strength in the machine direction, and
wherein the abrasive layer comprises a blend of exploded ceramic abrasive particles and crushed fusion abrasive particles.

Embodiment 25

A coated abrasive article comprising:
a backing material;
an abrasive layer disposed on the backing material, wherein the abrasive layer comprises a blend of abrasive particles comprising:
a first plurality of abrasive particles; and
a second plurality of abrasive particles,
wherein the first plurality of abrasive particles comprise exploded ceramic abrasive particles and the second plurality of abrasive particles comprise crushed fusion abrasive particles,
wherein the backing material comprises a fibrous mixture of a plurality of cellulosic fibers and a plurality of synthetic fibers, and wherein the backing material comprises a tear strength in the cross direction that is at least equal to the tear strength in the machine direction.

Embodiment 26

The coated abrasive article of embodiment 25, wherein the exploded ceramic abrasive particles comprise exploded ceramic aluminum oxide abrasive particles.

Embodiment 27

The coated abrasive article of embodiment 26, wherein the exploded ceramic aluminum oxide abrasive particles further comprise a dopant.

Embodiment 28

The coated abrasive article of embodiment 27, wherein the dopant is magnesium oxide.

Embodiment 29

The coated abrasive article of embodiment 28, wherein the dopant is present in an amount not less than 0.1 wt % and not greater than 3.0 wt %.

Embodiment 30

The coated abrasive article of embodiment 25, wherein the crushed fusion abrasive particles comprise crushed fusion semi-friable aluminum oxide particles.

Embodiment 31

The coated abrasive article of embodiment 30, wherein the crushed fusion aluminum oxide semi-friable abrasive particles comprise heat treated particles.

Embodiment 32

The coated abrasive article of embodiment 25, wherein the backing material comprises a ratio of a tear strength in a machine direction to a tear strength in a cross direction ($MD_{strength}$:$CD_{strength}$) in a range from 1:1 to 1:4.

Embodiment 33

The coated abrasive article of embodiment 25, wherein the backing material comprises a tear strength in the machine direction of at least 150 g force and a tear strength in the cross direction of at least 150 g force.

Embodiment 34

The coated abrasive article of embodiment 25, wherein the plurality of synthetic fibers comprises a polyolefin; a polytetrafluoroethylene; a polyester; a polyvinyl acetate; a polyvinyl chloride acetate; a polyvinyl butyral; an acrylic resin; a polyamide; a polyvinyl chloride; a polyvinylidene chloride; a polystyrene; a polyvinyl alcohol; a polyurethane; a polylactic acid; or a combination thereof.

Embodiment 35

The coated abrasive article of embodiment 25, wherein the cellulosic fibers comprise hardwood fibers.

Embodiment 36

The coated abrasive article of embodiment 25, wherein the fibrous mixture comprises about 4 wt % to about 20 wt % synthetic fibers.

Embodiment 37

The coated abrasive article of embodiment 25, wherein the fibrous mixture comprises about 80 wt % to about 96 wt % of cellulosic fibers.

Embodiment 38

The coated abrasive article of embodiment 25, wherein the synthetic fibers have an average length that is about 0.25 inches to about 1.5 inches.

Embodiment 39

The coated abrasive article of embodiment 25, wherein the first plurality of abrasive particles and the second plurality of abrasive particles are present in the abrasive layer at a ratio of 1:3.

Embodiment 40

The coated abrasive article of embodiment 25, wherein the first plurality of abrasive particles and the second plurality of abrasive particles are present in the abrasive layer at a ratio of 1:1.

Embodiment 41

The coated abrasive article of embodiment 25, wherein the first plurality of abrasive particles and the second plurality of abrasive particles are present in the abrasive layer at a ratio of 3:1.

Embodiment 42

The coated abrasive article of embodiment 25, wherein the first plurality of abrasive particles is present in an amount greater than or equal to 25 wt %.

Embodiment 43

The coated abrasive article of embodiment 42, wherein the second plurality of abrasive particles is present in an amount greater than or equal to 25 wt %.

Embodiment 44

A method of making a coated abrasive article comprising:
disposing an abrasive layer on a backing material,
wherein the backing material comprises a fibrous mixture of a plurality of cellulosic fibers and a plurality of synthetic fibers,
wherein the backing material comprises a tear strength in the cross direction that is at least equal to the tear strength in the machine direction, and
wherein the abrasive layer comprises a blend of exploded ceramic abrasive particles and crushed fusion abrasive particles.

EXAMPLES

Example 1a.—Paper Backing Material Tear Strength Testing

In order to test the strength of the coated abrasive article 100, described herein, test samples of the coated abrasive article 100 were created using the backing material 110 and then, tear tests and fold tests were performed on the test samples of the coated abrasive article 100. For comparison, coated abrasive articles were also prepared using three different backing materials currently available in the marketplace.

All samples were prepared using a Spellman coater using a standard binder layer and a standard size layer. For each sample to be tested, a backing was prepared such that it had sufficient size to cover the vacuum holes on the coater. The backing was coated with the binder layer using a drawdown knife (e.g., 2 mil for P80). Then, the coated backing was attached face up to the Spellman backing holder using vacuum. Abrasive particles, or grains, were spread on the grain bed with a desired grain weight (e.g., P80, P150, or P180). Thereafter, the holder was flipped over, the safety cover of the Spellman coater was closed, and the coater was turned on. After 10 seconds, the coater was turned off. Each sample was then subjected to 140° F. for twenty minutes (20 min).

After this step, the size coat layer was applied to each sample using a two-roll mill (~5 mil gap for a grain size of P80 and a C-wt backing). Each sample was then cured at 140° F. for twenty minutes (20 min) followed by an additional twenty minutes (20 min) of cure time at 180° F. Finally, the supersize coat layer, e.g., a metal stearate layer, was applied to each sample using a two-roll mill (~5 mil gap for a grain size of P80 and a C-wt backing). Each sample was then dried at 110° F. for ten minutes (10 min). The samples were then ready for testing.

The test samples of the coated abrasive article 100 described herein and the comparison samples were subjected to a tear test and a fold test. The tear test was performed using an Elmendorf Tear tester. The test samples and comparison samples were cut to a size of 2.5 inches by 3.0 inches in both the machine direction (MD) and the cross direction (CD). When testing in the MD, the samples were cut so that the 3 inch axis was parallel to the MD. When testing in the CD, the samples were cut so that the 3 inch axis was parallel to the CD. To maintain uniformity, the samples were die cut.

Prior to testing the samples, the Elmendorf Tear tester was leveled and a blank test was performed to verify a reading of zero. In order to perform a blank test, a user can press the release at the base of the tester, which lets the arm swing through where the paper sample would be place. If the blank test is correct, the pointer should read zero. It is important that the operator only allows the arm to swing through once. Otherwise, the arm can alter the reading if it is left to oscillate. It is also important that enough samples are used at the same time to give a reading between 20 and 80 on the scale for maximum accuracy. For example, two (2) samples can be used for a grit size of P150 and coarser. Three (3)

samples can be used for a grit size of P180 and finer. A minimum of six (6) tests were performed for each direction: CD and MD.

In order to perform the tests in each direction the three inch (3") width of each sample was placed so that it was parallel to the jaws of the tester. The clamps were tightened to secure each sample and a twenty millimeter (20 mm) slit was cut in each sample by pressing down on the lever attached to the knife on the tester. Finally, the samples were allowed to be torn by pressing down on the sector release. The average reading for each test direction is multiplied by the multiplying factor, 16, and then, divided by the number of samples used in the test. For example, an average reading of 23 using 2 pieces of paper results in a tear strength of 184 (23×16/2). The results for each direction are recorded in grams force. The results are shown in Table 1, below.

TABLE 1

Average Elmendorf Tear Strength.

| | S1 | C1 | C2 | C3 |
|---|---|---|---|---|
| Weight (gsm) | 137 | 120 | 104 | 104 |
| MD Tear (gram force) | 373 ± 34 | 130 ± 4 | 131 ± 14 | 129 ± 5 |
| CD Tear (gram force) | 459 ± 29 | 135 ± 6 | 114 ± 4 | 116 ± 7 |

Sample 1: Neenah paper NP0050-64
Comp. 1: Neenah FPR 120 GSM Blue BC Finishing Paper, Neenah Paper, Inc.
Comp. 2: Neenah DF 100 GSM FRP Blue Finishing Paper, Neenah Paper, Inc.
Comp. 2: 100 GSM FRP Champagne Finishing Paper, Neenah Paper, Inc.

Table 1 shows the average results of the tear test for a paper backing material S1 included in an inventive coated abrasive article 100 as described herein, and three comparison paper backing samples C1, C2, and C3. As indicated, the MD tear strength of S1 is significantly higher than the comparison samples. Specifically, if the deviation is ignored, the MD tear strength of S1 is approximately 2.8 times greater than each of the three comparison samples.

In a particular aspect, the coated abrasive article 100 made with the backing material 110 described herein includes an MD tear strength that is particularly beneficial.

As further indicated in Table 1, the CD tear strength of S1, is significantly higher than the comparison samples. Specifically, if the deviation is ignored, the CD tear strength of S1 is approximately 3.4 to 4.0 times greater than each of the three comparison samples.

In a particular aspect, a coated abrasive article 100 made with a backing material 110 as described herein includes a CD tear strength that is particularly beneficial.

Example 1b.—Paper Backing Material Fold Strength Testing

The samples also underwent a fold test that was performed using an M.I.T. Fold Endurance Tester. The fold tests were performed on samples having an abrasive grit size not coarser than P80 grit. All samples were placed in the humidity chamber of a humidifier at 50%±2% Relative Humidity and 70°±2° F. overnight before testing. Samples were selected that were free from winkles and blemishes not inherent in the paper. Further, the samples were selected so that the area of the sample subjected to the folding did not contain any portion of a watermark and appears to be the average opacity. Also, the long edges of the samples were clean-cut and parallel.

Specifically, ten (10) pieces of each sample were cut to a size of 1.5 cm×15 cm in both the MD and the CD. It is important that the 15 cm side is parallel to the MD when testing in the MD. Conversely, the 15 cm side is parallel to the CD when testing in the CD. Before testing begins, the operator must determine that the power switch to the test device is in the off position. The operator can then determine the amount of tension by pushing down the shaft at the top of the machine. The test device typically needs at least 1 kg before the test will run. For example, the test device may use 1.4 kg tension for raw paper and coated abrasives having a grit size between P1500 and P320. The test device may use 1.2 kg tension for coated abrasives having a grit size between P240 and P150. Further, the test device may utilize 1.1 kg tension for coated abrasives having a grit size between P120 and P80. The operator may keep the tension at the desired value by tightening the knob on the side of the machine head.

For testing, the strip of each sample was secured in the test machine by tightening the top notch and the bottom notch. For testing coated abrasive products, the samples were inserted with the grit side facing out. This orientation remained constant for the remainder of the tests. After each sample test strip is secure and taut, the tension value is maintained before beginning the test. Before beginning each test, it was ensured that the counter read zero before loosening the tension knob. Thereafter, the test machine was turned on and the tester was allowed to fold the test sample until it breaks. The number of folds that were made before breaking each sample in each direction were recorded and averaged. The test results are shown below in Table 2.

TABLE 2

Average Fold Testing.

| | S1 | C1 | C2 | C3 |
|---|---|---|---|---|
| Weight (gsm) | 137 | 120 | 104 | 104 |
| MD Fold # before break | 252 ± 77 | 656 ± 110 | 492 ± 102 | 691 ± 102 |
| CD Fold # before break | 519 ± 484 | 225 ± 49 | 190 ± 48 | 122 ± 41 |

Sample 1: Neenah paper, NP0050-64
Comp. 1: Neenah FPR 120 GSM Blue BC Finishing Paper, Neenah Paper, Inc.
Comp. 2: Neenah DF 100 GSM FRP Blue Finishing Paper, Neenah Paper, Inc.
Comp. 3: 100 GSM FRP Champagne Finishing Paper, Neenah Paper, Inc.

Table 2, shows the average results of the fold tests of a paper backing material S1 included in an inventive coated abrasive article 100 as described herein and three comparison samples C1, C2, and C3. As indicated in Table 2, the MD tear strength of S1 appears to be more brittle (i.e., rigid) in the MD direction than the comparative samples.

As further indicated in Table 2, the CD fold strength of Sample 1 is significantly higher than the comparison samples.

Example 2—Abrasive Performance Testing—DA Testing 1

Figure 10:
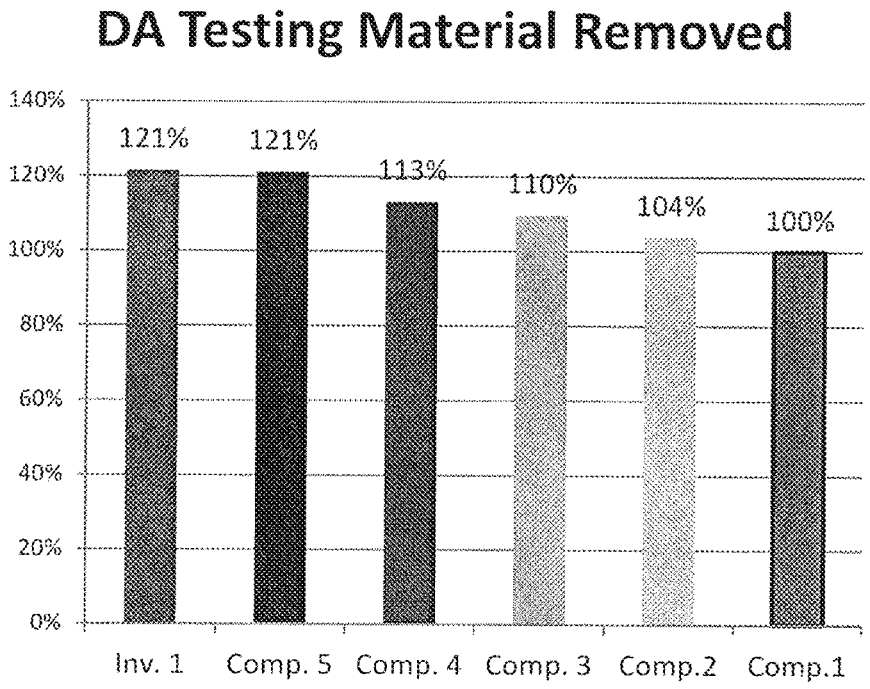
FIG. 10 is a chart showing the material removal performance of inventive embodiments and comparative coated abrasive articles.
Figure 11:
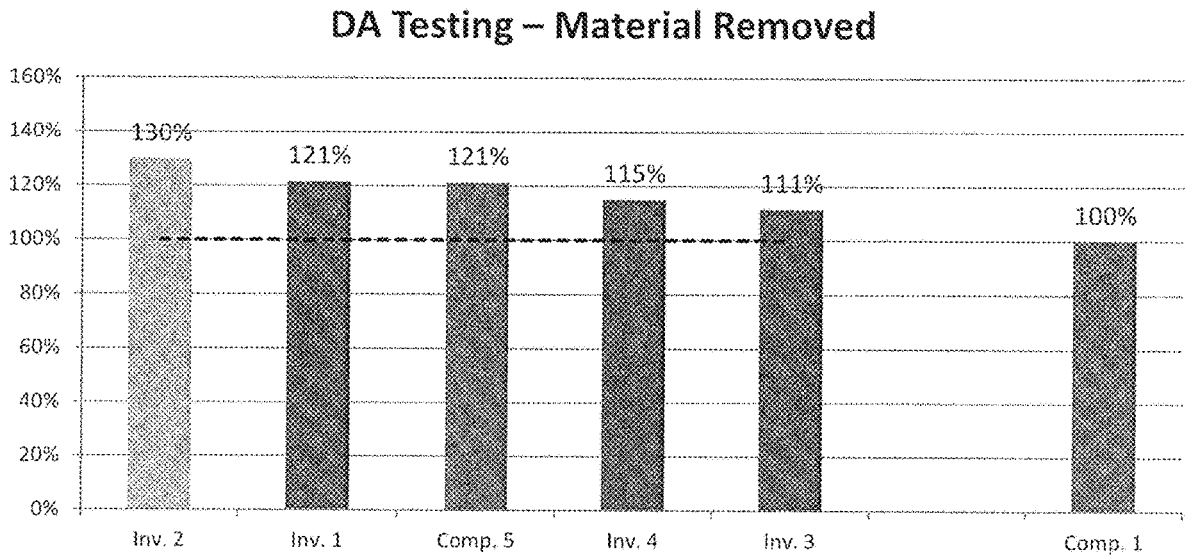
FIG. 11 is another chart showing the material removal performance of inventive embodiments and comparative coated abrasive articles.

Inventive and comparative coated abrasives were constructed that included an abrasive grain blend and a backing material as indicated below in Table 3. All coated abrasive samples included a make coat, a size coat, and a supersize coat as described herein. The coated abrasive samples only differed with respect to grain blend and backing material as indicated in Table 3. The coated abrasives were used to conduct dual action abrasive performance testing (DA Testing) on acrylic panels. The results are shown in Table 3 and illustrated in FIG. 10 and FIG. 11.

TABLE 3

Coated Abrasive DA 1 Testing Samples

| Name | Grain Blend Abrasive Grain 1 | Grain Blend Abrasive Grain 2 | Grain Blend Abrasive Grain 3 | Backing Material | Cumulative Material Removed (As a % of Comp. 1) |
|---|---|---|---|---|---|
| Comp. 1 | 25% Ceramic A | 75% Fusion Abrasive | — | C1 | 100% |
| Comp. 2 | 25% Ceramic A | 75% Fusion Abrasive | — | S1 | 104% |
| Comp. 3 | 50% Ceramic A | 50% Fusion Abrasive | — | S1 | 110% |
| Comp. 4 | 75% Ceramic A | 25% Fusion Abrasive | — | S1 | 113% |
| Comp. 5 | 100% Ceramic A | 0% Fusion Abrasive | — | S1 | 121% |
| Inv. 1 | 50% Ceramic B | 50% Fusion Abrasive | — | S1 | 130% |
| Inv. 2 | 50% Ceramic C | 50% Fusion Abrasive | — | S1 | 121% |
| Inv. 3 | 50% Ceramic D | 50% Fusion Abrasive | — | S1 | 111% |
| Inv. 4 | 25% Ceramic C | 25% Ceramic D | 50% Fusion Abrasive | S1 | 115% |

Ceramic "A"—Crushed Ceramic Seeded Gel Aluminum Oxide, P80 grit size
Ceramic "B"—Exploded Ceramic Aluminum Oxide, P80 grit size
Ceramic "C"—Exploded Ceramic Aluminum Oxide, MgO Doped 0.5-1.5 wt %, P80 grit size
Ceramic "D"—Exploded Ceramic Aluminum Oxide, MgO Doped 0.5-1.5 wt %, P24 grit size that is then roller crushed down to P80 grit size
Fusion Abrasive—Brown Fused Aluminum Oxide, P80 grit size Inventive samples 1-3 (Inv. 1-Inv.3) included grain blends comprised of an exploded ceramic aluminum oxide abrasive grain and a crushed fusion aluminum oxide abrasive grain as well as paper backing material that includes a nonwoven fibrous mixture of cellulosic fibers and synthetic fibers, and possesses tear strength characteristics as described herein. Inventive sample 4 (Inv. 4) was the same as the other inventive samples except it included a grain blend comprising two exploded ceramic aluminum oxide abrasive grains and a crushed fusion aluminum oxide abrasive grain. As shown, all inventive samples unexpectedly and surprisingly produced significantly improved abrasive performance compared to the comparative samples.

Example 3—Abrasive Performance Testing—DA Testing 2

Inventive and comparative coated abrasives were constructed that included an abrasive grain blend and a backing material as indicated below in Table 4. All coated abrasive samples included a make coat, a size coat, and a supersize coat as described herein. The coated abrasive samples only differed with respect to grain blend and backing material as indicated in Table 4. The coated abrasives were used to conduct dual action abrasive performance testing (DA Testing) on acrylic panels. The results are shown in Table 4 and illustrated in FIG. 12.

TABLE 4

Coated Abrasive DA 2 Testing Samples

| Name | Grain Blend Abrasive Grain 1 | Grain Blend Abrasive Grain 2 | Grain Blend Abrasive Grain 3 | Backing Material | Cumulative Material Removed (As a % of Comp. 1) |
|---|---|---|---|---|---|
| Comp. 1 | 25% Ceramic A | 75% Fusion A | — | C1 | 100% |

TABLE 4-continued

Coated Abrasive DA 2 Testing Samples

| Name | Grain Blend Abrasive Grain 1 | Grain Blend Abrasive Grain 2 | Grain Blend Abrasive Grain 3 | Backing Material | Cumulative Material Removed (As a % of Comp. 1) |
|---|---|---|---|---|---|
| Inv. 2 | 50% Ceramic C | 50% Fusion A | — | S1 | 116% |
| Comp. 6 | 25% Ceramic E | 75% Fusion B | — | C1 | 100% |
| Inv. 5 | 50% Ceramic E | 50% Fusion B | — | S1 | 134% |

Figure 12:
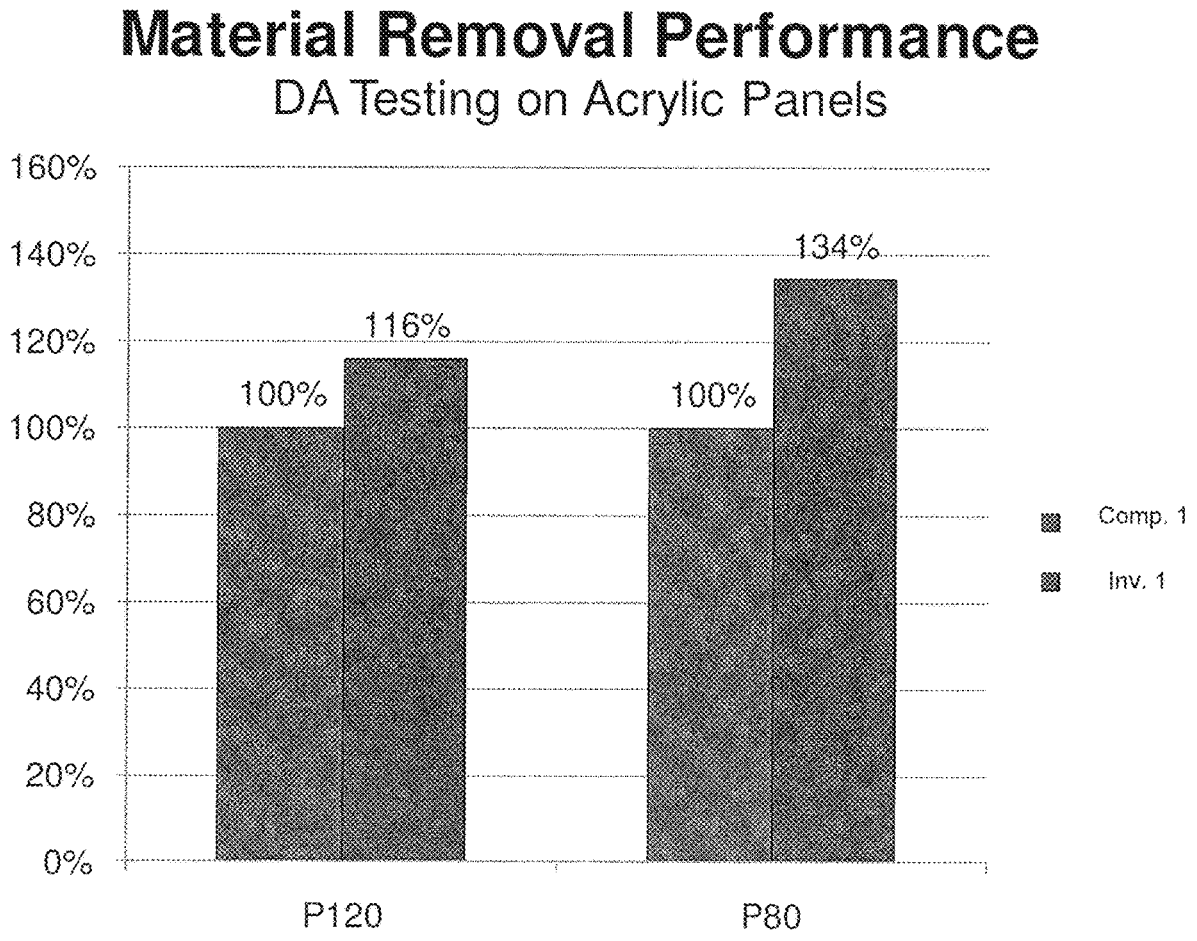
FIG. 12 is a chart showing the material removal performance of an inventive coated abrasive embodiment and a comparative coated abrasive article.

Ceramic "C"—Exploded Ceramic Aluminum Oxide, MgO Doped 0.5-1.5 wt %, P80 grit size
Fusion "A"—Brown Fused Aluminum Oxide, P80 grit size
Ceramic "E"—Exploded Ceramic Aluminum Oxide, MgO Doped 0.5-1.5 wt %, P120 grit size
Fusion "B"—Brown Fused Aluminum Oxide, P120 grit size As shown in Table 4 and FIG. 12, inventive embodiments Inv.2 and Inv. 5 unexpectedly and surprisingly showed significant beneficial abrasive performance over comparative samples Comp. 1 and Comp. 6. For a coated abrasive article having a grit size of P120 grit, inventive sample Inv. 2 demonstrated a 16% greater material removal when measured during a dual action (DA) test on an acrylic panel. Moreover, for a coated abrasive article having a grit size of P80 grit, inventive sample Inv. 6 demonstrated a 34% greater material removal when measured during a dual action (DA) test on an acrylic panel. Based on the testing data, inventive coated abrasive articles as described in detail herein, demonstrate superior performance when compared to state-of-the art coated abrasive articles.

Example 4—Edge Wear Testing

Inventive sample (Inv. 6) and comparative sample (Comp. 7) coated abrasives discs were constructed that included ceramic abrasive grains and a backing material as indicated below in Table 5. All coated abrasive samples included a make coat, a size coat, and a supersize coat as described herein. The coated abrasive samples only differed with respect to the backing material as indicated in Table 5. The coated abrasives were used to conduct paint removal on different sections of automotive test pieces (automotive hood). The results are shown in Table 5 and illustrated in FIG. 13 and FIG. 14.

TABLE 5

Edge Wear Testing Results

| Name | Abrasive Grain | Backing Material | Test Type | Edge wear Pass/Fail |
|---|---|---|---|---|
| Comp. 7 | 100% Ceramic F | C3 | Auto Hood—Inside Corner | Fail |
| Comp. 7 | 100% Ceramic F | C3 | Auto Hood—Narrow Valley & Edge | Fail |
| Inv. 6 | 100% Ceramic F | S1 | Auto Hood—Inside Corner | Pass |
| Inv. 6 | 100% Ceramic F | S1 | Auto Hood—Narrow Valley & Edge | Pass |

Ceramic F—Exploded Ceramic Aluminum Oxide, MgO Doped 0.5-1.5 wt %, P36 grit size
Sample 1 (S1): Neenah paper, NP0050-64
Comp. 3 (C3): 100 GSM FRP Champagne Finishing Paper, Neenah Paper, Inc.

Figure 13:
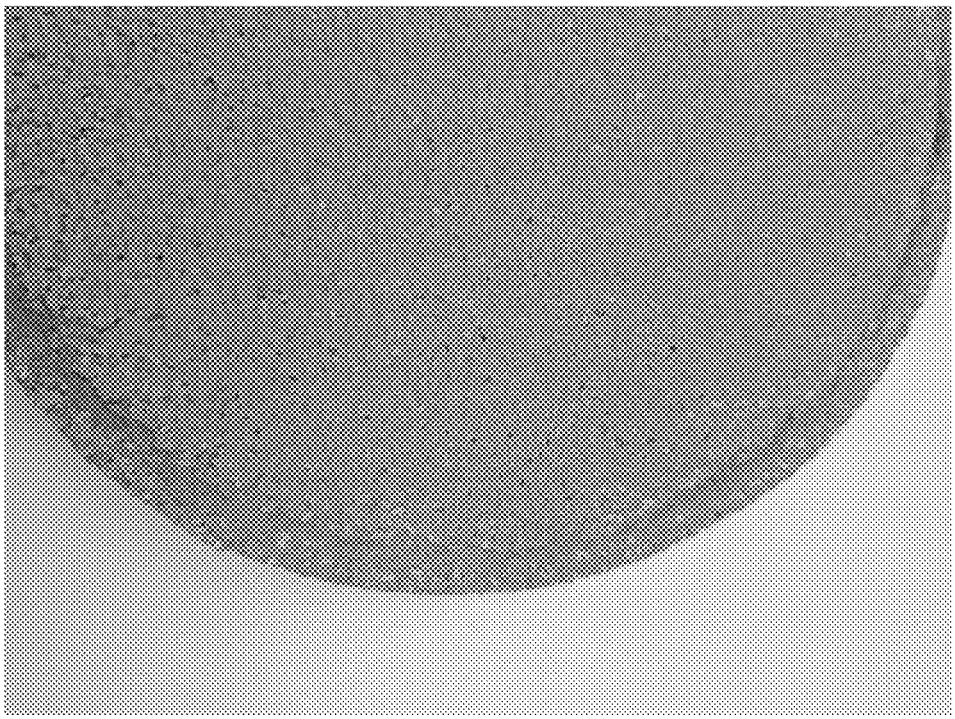
FIG. 13 is an image of a conventional abrasive disc that shows excessive wear along the outer edge of the disc after use.
Figure 14:
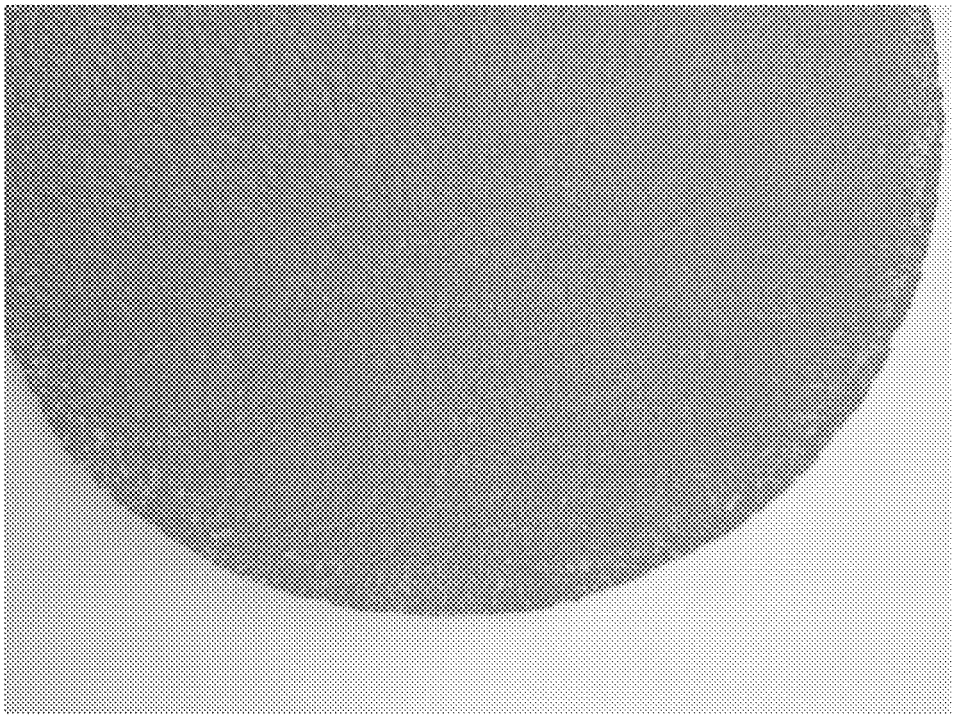
FIG. 14 is an image of an embodiment of abrasive disc that includes increased tear resistance and shows reduced wear along the outer edge after use.

Paint removal was conducted on the automotive hood pieces at specific locations to test the resilience of the abrasive disc samples and to determine whether the abrasive discs exhibited acceptable or excessive edge wear. As shown by the results, the conventional abrasive discs exhibited excessive and unacceptable edge wear. FIG. 13 shows an image of one of the conventional abrasive discs and the excessive wear along the outer edge of the disc after use. In contrast, the inventive sample unexpectedly and surprisingly was able to accomplish the paint removal with a greatly reduced amount of edge wear, such that only a small amount of edge wear occurred. FIG. 14 shows an image of one of the inventive sample abrasive discs that includes increased tear resistance and shows much reduced wear along the outer edge after use.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity cannot be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A coated abrasive article comprising:

a backing material;

an abrasive layer disposed on the backing material, wherein the abrasive layer comprises a blend of abrasive particles comprising:

a first plurality of abrasive particles; and a second plurality of abrasive particles;

wherein the first plurality of abrasive particles comprise exploded ceramic abrasive particles and the second plurality of abrasive particles comprise crushed fusion abrasive particles; and wherein the backing material comprises a fibrous mixture of a plurality of cellulosic fibers and a plurality of synthetic fibers, and wherein the backing material comprises a ratio of a tear strength in the machine direction to a tear strength in the cross direction (MDstrength:CDstrength) that is at least 1:1.05.

2. The coated abrasive article of claim 1, wherein the exploded ceramic abrasive particles comprise exploded ceramic aluminum oxide abrasive particles.

3. The coated abrasive article of claim 2, wherein the exploded ceramic aluminum oxide abrasive particles further comprise a dopant.

4. The coated abrasive article of claim 3, wherein the dopant is magnesium oxide.

5. The coated abrasive article of claim 4, wherein the dopant is present in an amount not less than 0.1 wt % and not greater than 3.0 wt %.

6. The coated abrasive article of claim 1, wherein the crushed fusion abrasive particles comprise crushed fusion semi-friable aluminum oxide particles.

7. The coated abrasive article of claim 6, wherein the crushed fusion aluminum oxide semi-friable abrasive particles comprise heat treated particles.

8. The coated abrasive article of claim 1, wherein the ratio of the tear strength in the machine direction to the tear strength in the cross direction (MDstrength:CDStrength) is in a range from 1:1.05 to 1:4.

9. The coated abrasive article of claim 1, wherein the backing material comprises a tear strength in the machine direction of at least 150 g force and a tear strength in the cross direction of at least 150 g force.

10. The coated abrasive article of claim 1, wherein the plurality of synthetic fibers comprises a polyolefin; a polytetrafluoroethylene; a polyester; a polyvinyl acetate; a polyvinyl chloride acetate; a polyvinyl butyral; an acrylic resin; a polyamide; a polyvinyl chloride; a polyvinylidene chloride; a polystyrene; a polyvinyl alcohol; a polyurethane; a polylactic acid; or a combination thereof.

11. The coated abrasive article of claim 1, wherein the cellulosic fibers comprise hardwood fibers.

12. The coated abrasive article of claim 1, wherein the fibrous mixture comprises about 4 wt % to about 20 wt % synthetic fibers.

13. The coated abrasive article of claim 1, wherein the fibrous mixture comprises about 80 wt % to about 96 wt % of cellulosic fibers.

14. The coated abrasive article of claim 1, wherein the synthetic fibers have an average length that is about 0.25 inches to about 1.5 inches.

15. The coated abrasive article of claim 1, wherein the first plurality of abrasive particles and the second plurality of abrasive particles are present in the abrasive layer at a ratio of 1:3.

16. The coated abrasive article of claim 1, wherein the first plurality of abrasive particles and the second plurality of abrasive particles are present in the abrasive layer at a ratio of 1:1.

17. The coated abrasive article of claim 1, wherein the first plurality of abrasive particles and the second plurality of abrasive particles are present in the abrasive layer at a ratio of 3:1.

18. The coated abrasive article of claim 1, wherein the first plurality of abrasive particles is present in an amount greater than or equal to 25 wt %.

19. The coated abrasive article of claim 18, wherein the second plurality of abrasive particles is present in an amount greater than or equal to 25 wt %.

20. A method of making a coated abrasive article comprising:

disposing an abrasive layer on a backing material, wherein the backing material comprises a fibrous mixture of a plurality of cellulosic fibers and a plurality of synthetic fibers, wherein the backing material comprises a ratio of a tear strength in the machine direction to a tear strength in the cross direction (MDstrength: CDstrength) that is at least 1:1.05, and wherein the abrasive layer comprises a blend of exploded ceramic abrasive particles and crushed fusion abrasive particles.

* * * * *